US008224215B2

(12) United States Patent
Sato et al.

(10) Patent No.: US 8,224,215 B2
(45) Date of Patent: Jul. 17, 2012

(54) IMAGE FORMING APPARATUS AND REMOVABLE CARTRIDGE

(75) Inventors: Shougo Sato, Seto (JP); Masahiro Ishii, Nagoya (JP); Tsutomu Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/157,267

(22) Filed: Jun. 9, 2011

(65) Prior Publication Data

US 2011/0236039 A1 Sep. 29, 2011

Related U.S. Application Data

(62) Division of application No. 11/363,161, filed on Feb. 28, 2006, now Pat. No. 7,979,006.

(30) Foreign Application Priority Data

Feb. 28, 2005 (JP) ..... 2005-053796
Jul. 19, 2005 (JP) ..... 2005-208443

(51) Int. Cl.
*G03G 15/08* (2006.01)

(52) U.S. Cl. ..... 399/263; 399/25; 399/120; 399/254

(58) Field of Classification Search ..... 399/25, 399/61, 99, 110, 111, 113, 114, 119, 120, 399/252, 254, 256, 257, 262, 263
See application file for complete search history.

(56) References Cited

U.S. PATENT DOCUMENTS 4,839,691 A 6/1989 Tagawa et al.
5,523,832 A 6/1996 Hamamichi et al.
5,541,714 A * 7/1996 Watanabe et al. ..... 399/120
5,608,501 A 3/1997 Makino
5,742,882 A 4/1998 Lee
5,867,756 A * 2/1999 Suzuki et al. ..... 399/255
6,127,083 A 10/2000 Nomura et al.
6,169,865 B1 1/2001 Miyabe et al.
6,351,618 B1 2/2002 Pollocks, Jr.
6,501,933 B2 12/2002 Ishii
6,823,155 B2 11/2004 Tsuda et al.

(Continued)

FOREIGN PATENT DOCUMENTS

CN 1167280 A 12/1997

(Continued)

OTHER PUBLICATIONS

State Intellectual Property Office, The First Office Action for Chinese Patent Application No. 2006100550153 (counterpart to above-captioned patent application), mailed Jun. 27, 2008 (submitted with parent).

(Continued)

*Primary Examiner* — David Porta
*Assistant Examiner* — Jessica L Eley
(74) *Attorney, Agent, or Firm* — Baker Botts L.L.P.

(57) ABSTRACT

An image forming apparatus includes: an electrostatic latent image bearing member; a toner cartridge; a developing member; a transfer member; a developing device; and circulating member. The toner cartridge is removably coupled to the developing device. The developing device incorporates the developing member. The circulating member is capable of operating while the toner cartridge remains coupled to the developing device, to circulate the toner between the developing device and the toner cartridge irrespective of whether the developing member is operating.

6 Claims, 25 Drawing Sheets

FIG.27

U.S. PATENT DOCUMENTS

| | | | | |
|---|---|---|---|---|
| 7,252,918 | B2 | 8/2007 | Nakamura et al. | |
| 7,272,336 | B1 | 9/2007 | Dawson et al. | |
| 7,321,739 | B1 | 1/2008 | Dawson et al. | |
| 2001/0041079 | A1 | 11/2001 | Michlin et al. | |
| 2003/0156848 | A1 | 8/2003 | Kawai et al. | |
| 2004/0131382 | A1 | 7/2004 | Kikuchi et al. | |
| 2005/0117920 | A1* | 6/2005 | Ogata et al. | 399/27 |
| 2006/0193652 | A1 | 8/2006 | Sato | |
| 2006/0193658 | A1 | 8/2006 | Sato | |

FOREIGN PATENT DOCUMENTS

| | | | |
|---|---|---|---|
| CN | 1201533 | A | 12/1998 |
| CN | 200947164 | Y | 9/2007 |
| DE | 4223147 | A1 | 1/1993 |
| EP | 0670530 | A2 | 9/1995 |
| EP | 0770931 | A2 | 5/1997 |
| JP | H01-193877 | A | 8/1989 |
| JP | H03-180875 | A | 8/1991 |
| JP | H03-204667 | A | 9/1991 |
| JP | H04-031884 | A | 2/1992 |
| JP | H06-019306 | A | 1/1994 |
| JP | H06-102765 | A | 4/1994 |
| JP | H06-222668 | A | 8/1994 |
| JP | H07-113805 | A | 12/1995 |
| JP | H09-090733 | A | 4/1997 |
| JP | H09-211948 | A | 8/1997 |
| JP | H09-222796 | A | 8/1997 |
| JP | H09-319201 | A | 12/1997 |
| JP | H09-319214 | A | 12/1997 |
| JP | H10-274881 | A | 10/1998 |
| JP | H11-133711 | A | 5/1999 |
| JP | H11-218957 | A | 8/1999 |
| JP | H11-305629 | A | 11/1999 |
| JP | H11-327288 | A | 11/1999 |
| JP | 3044997 | B2 | 3/2000 |
| JP | 2000-098727 | A | 4/2000 |
| JP | 2000-122423 | A | 4/2000 |
| JP | 2000-187382 | A | 7/2000 |
| JP | 2000-187431 | A | 7/2000 |
| JP | 2000-267420 | A | 9/2000 |
| JP | 2001-092256 | A | 4/2001 |
| JP | 2002-040783 | A | 2/2002 |
| JP | 2002-156891 | A | 5/2002 |
| JP | 2002-169365 | A | 6/2002 |
| JP | 2002-244533 | A | 8/2002 |
| JP | 2002-258693 | A | 9/2002 |
| JP | 2002-287473 | A | 10/2002 |
| JP | 2003-186369 | A | 7/2003 |
| JP | 2004-012652 | A | 1/2004 |
| JP | 3595798 | B2 | 9/2004 |

OTHER PUBLICATIONS

Japan Patent Office, Office Action in Patent Application No. JP 2005-053796 (counterpart to above-captioned patent application), mailed May 27, 2008 (submitted with parent).

Japan Patent Office, Office Action in Patent Application No. JP 2005-053070 (counterpart to above-captioned patent application), mailed May 27, 2008 (submitted with parent).

European Patent Office, European Search Report for Patent Application No. EP 06 00 3846 (counterpart to above-captioned application) dated Nov. 22, 2007 (submitted with parent).

European Patent Office, European Search Report for Patent Application No. EP 06 003 853.6 (counterpart to above-captioned application) dated Jan. 18, 2008 (submitted with parent).

Japan Patent Office, Office Action in Patent Application No. JP 2005-208443 (counterpart to above-captioned patent application), mailed Oct. 14, 2008 (submitted with parent).

State Intellectual Property Office, The First Office Action for Chinese Patent Application No. 2008101767706 (counterpart to above-captioned patent application), mailed Apr. 14, 2010 (submitted with parent).

* cited by examiner

IMAGE FORMING APPARATUS AND REMOVABLE CARTRIDGE

CROSS REFERENCE TO RELATED APPLICATIONS

This application is a divisional application of U.S. patent application Ser. No. 11/363,161 filed Feb. 28, 2006, which claims the benefit of Japanese Patent Application Nos. 2005-53796 filed Feb. 28, 2005 and 2005-208443 filed Jul. 19, 2005, the disclosures of which are incorporated herein by reference in their entirety.

TECHNICAL FIELD

The disclosure relates to an image forming apparatus of an electronic photographic type, in which an electrostatic latent image formed on an electrostatic latent image bearing body is developed into a toner image and the toner image is transferred to a recording medium, and to a cartridge that can be used in the image forming apparatus.

BACKGROUND

There has been proposed an image forming apparatus of a type that includes an image bearing body having a surface on which an electrostatic latent image is formed, a toner cartridge containing toner for developing the electrostatic latent image, a developing member for subjecting the toner from the toner cartridge to frictional electrification and applying the toner to the surface of the image bearing body, thereby developing the electrostatic latent image into a toner image, a transfer member for transferring the toner image from the image bearing body to a recording medium, and a developing device which incorporates at least the developing member and in which the toner cartridge is removably provided. In the image forming apparatus of this type, after an electrostatic latent image is formed on the surface of the image bearing body, the developing member applies the toner from the toner cartridge to the surface of the electrostatic latent image bearing body by frictional electrification, thus developing the latent image. A toner image is thereby formed. Then, the transfer member transfers the toner image to a recording medium. As a result, an image corresponding to the electrostatic latent image is formed on the recording medium. Since the toner cartridge can be removed from the developing device that incorporates the developing member, the toner cartridge can be replaced by a new one when the toner is consumed up. Thus, image formation can be continued.

U.S. Pat. No. 5,867,756 has proposed an image forming apparatus of this type, in which a supplying member, such as an agitator, is provided in the toner cartridge to supply toner from the toner cartridge to the developing device and a returning member, such as auger rollers, is provided in the housing of the developing device, to return the toner from the developing device into the toner cartridge. The supplying member and the returning member are operated at the same time, thereby circulating toner between the developing device and the toner cartridge. Thus, the toner is prevented from coagulating and hardening at a particular position. Fluidity is ensured for the toner, enhancing the quality of images.

SUMMARY

However, images that the image forming, apparatus of this type forms will possibly be degraded in quality when the toner cartridge is replaced by a new one. Toner is degraded as the image forming apparatus repeatedly performs the image-forming operation. Toner, particularly a non-magnetic single-component toner, is degraded as the toner particles repeatedly move in sliding contact with the developing roller and a layer-regulating member provided in the image forming apparatus, and are repeatedly electrically charged in friction. The thus degraded toner has its electrical chargeability decreased. Accordingly, in some cases, old toner that has been repeatedly subjected to the frictional electrification and new toner that has not yet been subjected to the frictional electrification differ in electrical chargeability. If new toner and old toner are mixed and used, they will not be charged to the same polarity. The new toner will be positively charged, while the old toner, or degraded toner, will be negatively charged. The older toner negatively charged will stick to those parts of an electrostatic latent image, which are positively charged, i.e., the parts that should be developed to white solid parts or blank parts of a toner image. Consequently, so-called print togging will take place.

In view of the foregoing, an object of the invention is to provide an image forming apparatus and a cartridge that can prevent print fogging from occurring.

In order to attain the above and other objects, the invention provides an image forming apparatus, including: an electrostatic latent image bearing member; a toner cartridge; a developing member; a transfer member; a developing device; and circulating member. The electrostatic latent image bearing member has a surface on which an electrostatic latent image is formed. The toner cartridge contains toner. The developing member supplies the toner from the toner cartridge onto the surface of the electrostatic latent image bearing member, thereby developing the electrostatic latent image into a toner image. The transfer member transfers the toner image from the surface of the electrostatic latent image bearing member to a recording medium. The toner cartridge is removably coupled to the developing device. The developing device incorporates the developing member. The circulating member is capable of operating while the toner cartridge remains coupled to the developing device, to circulate the toner between the developing device and the toner cartridge irrespective of whether the developing member is operating.

According to another aspect, the invention provides a removable cartridge for use in an image forming apparatus, including: a receiving portion that detachably receives a toner cartridge that contains toner; a developing member that subjects toner from the toner cartridge to frictional electrification to apply the toner to a surface of an image bearing body, thereby developing an electrostatic latent image formed on the image bearing body; and a returning member that returns the toner from the cartridge into the toner cartridge, the returning member being able to operate, regardless of whether the developing member is operating or not.

According to another aspect, the invention provides a removable toner cartridge configured to be coupled to a developing device that comprises at least a developing member that subjects toner to frictional electrification to apply the toner to a surface of an image bearing body, thereby to develop an electrostatic latent image formed on the surface of the image bearing body into a toner image, the toner cartridge including: a supplying member capable of operating while being coupled to the developing device, irrespective of whether the developing member is operating, and configured to supply to the developing device the toner contained in the toner cartridge.

According to another aspect, the invention provides an image forming apparatus, including: an electrostatic latent image bearing member; a toner cartridge; a developing member; a transfer member; a developing device; a supplying member; and a returning member. The electrostatic latent image bearing member has a surface on which an electrostatic latent image is formed. The toner cartridge contains toner. The developing member supplies the toner from the toner cartridge onto the surface of the electrostatic latent image bearing member, thereby developing the electrostatic latent image into a toner image. The transfer member transfers the toner image from the surface of the electrostatic latent image bearing member to a recording medium. The toner cartridge is removably coupled to the developing device. The developing device incorporates the developing member. The supplying member supplies the toner from the toner cartridge to the developing device. The returning member recovers the toner from the developing device into the toner cartridge. The returning member is able to operate independently from the supplying member.

According to another aspect, the invention provides a removable cartridge for use in an image forming apparatus, including: a receiving portion that detachably receives a toner cartridge that contains toner and that is provided with a supplying member that supplies toner to a developing member; the developing member that supplies toner from the toner cartridge to a surface of an electrostatic latent image bearing body, thereby developing an electrostatic latent image formed on the image bearing body; and a returning member that returns the toner into the toner cartridge, the returning member being able to perform, independently from a supplying operation of the supplying member.

DETAILED DESCRIPTION

Figure 1:
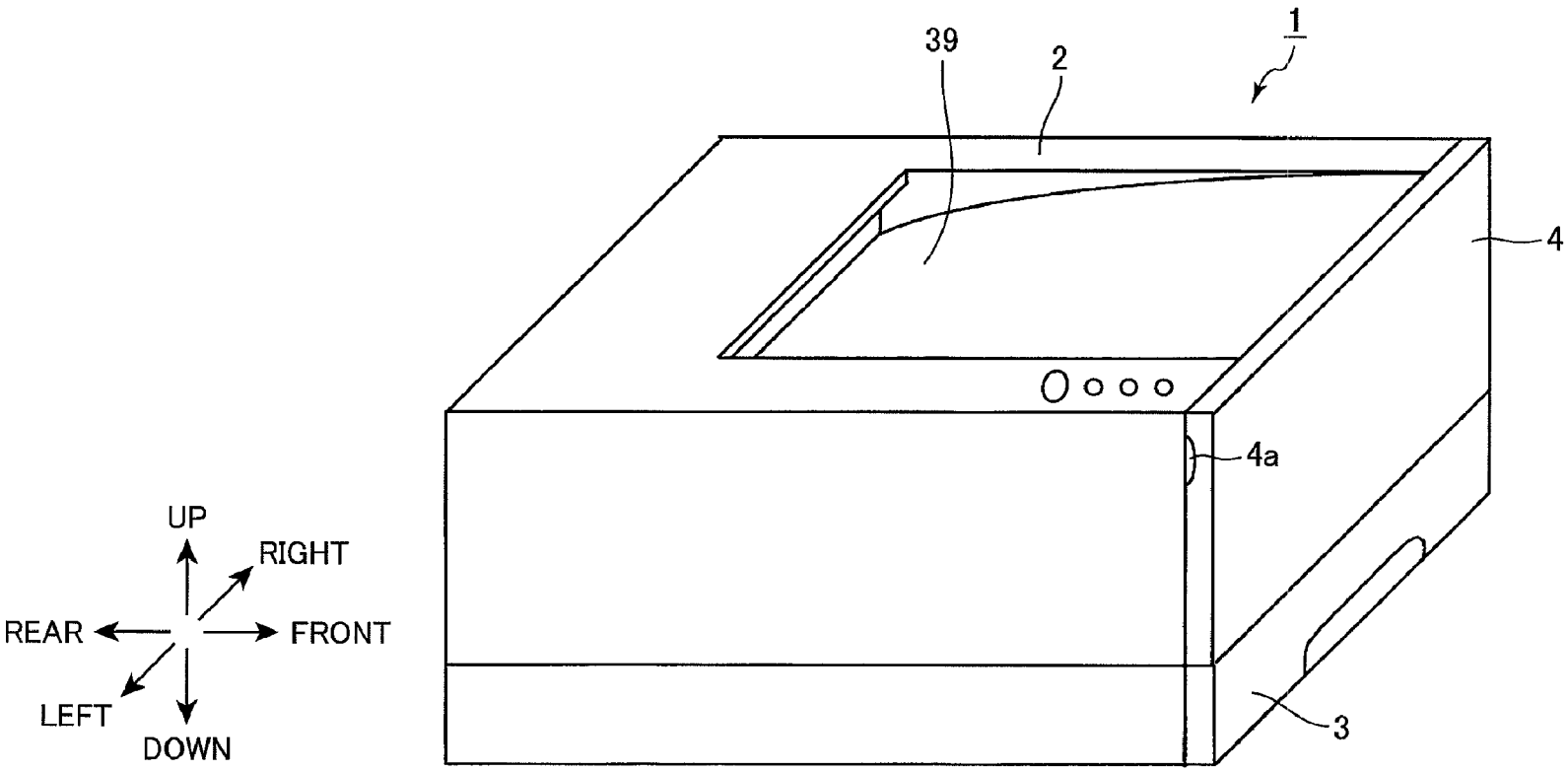
FIG. 1 is a perspective view of a laser printer according to a first embodiment of the invention.

An image forming apparatus according to embodiments of the invention will be described while referring to the accompanying drawings wherein like parts and components are designated by the same reference numerals to avoid duplicating description.

FIG. 1 is a perspective view representing the outer appearance of a laser printer 1 according to a first embodiment of the invention. The laser printer 1 is for forming images by using non-magnetic single-component toner of positive charging nature. A representative example of the toner is styrene-acryl polymerized toner.

The terms "upward", "downward", "upper", "lower", "above", "below", "beneath", "left", "right" and the like will be used throughout the description assuming that the laser printer 1 is disposed in an orientation in which it is intended to be used. In use, the laser printer 1 is disposed as shown in FIG. 1. The left-and-right direction defined in the laser printer 1 is equivalent to the widthwise direction of a sheet of paper that is conveyed in the laser printer 1.

As shown in FIG. 1, a cover 2 is provided covering the outer periphery of the main body of the laser printer 1. A sheet cassette 3 is mounted below the cover 2.

Figure 2:
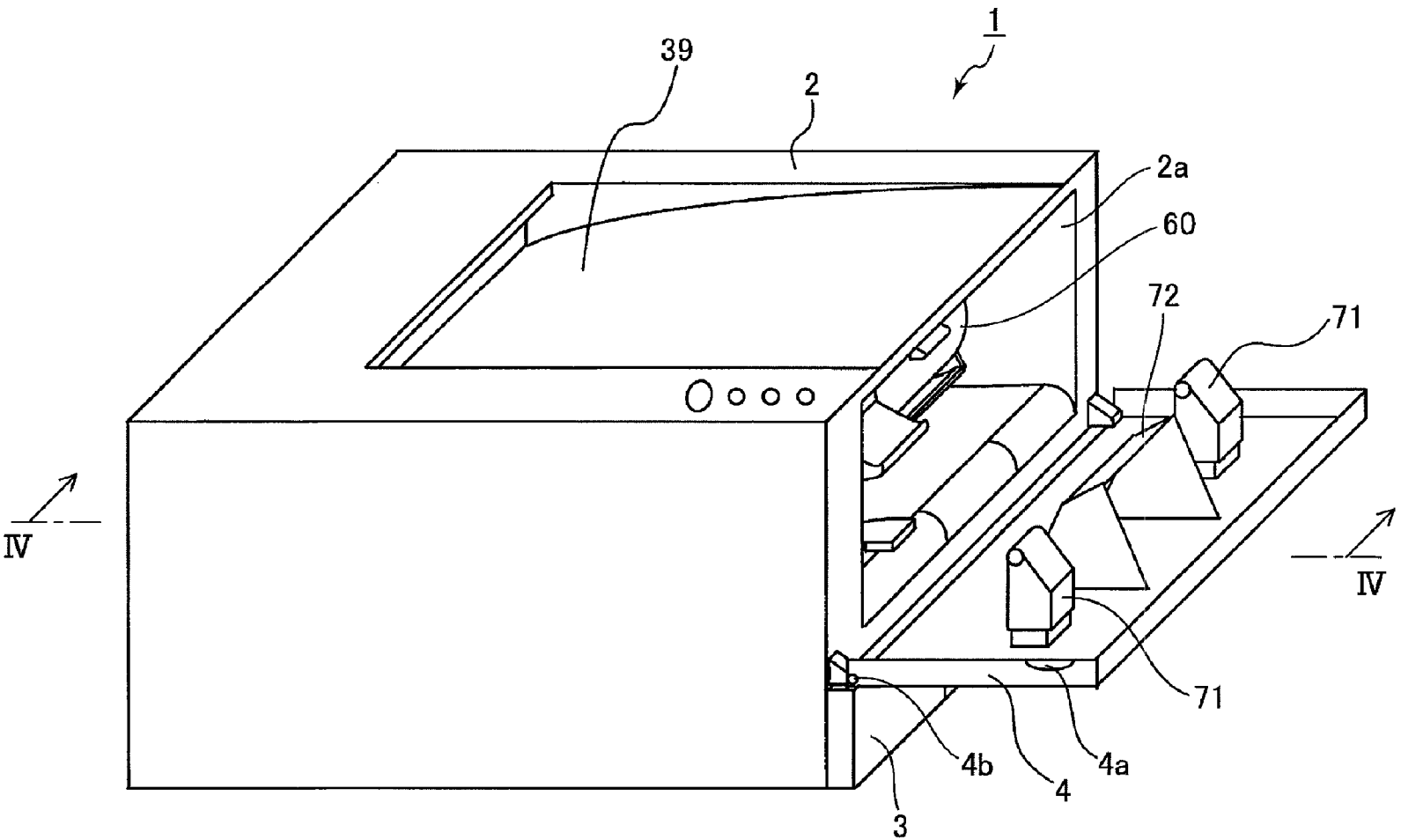
FIG. 2 is a perspective view of the laser printer, illustrating how a lid of the laser printer is opened.

As shown in FIG. 2, the cover 2 defines an opening 2*a* at its front side, and has a lid 4 that can open and close the opening 2*a*. Usually, the lid 4 closes the opening 2*a* as shown in FIG. 1.

The lid 4 has finger rests 4*a* on the upper left and right sides, respectively. The user may hold the lid 4, placing his or her fingers in the finger rests 4*a*, and then pull the lid 4. As a result, as shown in FIG. 2, the lid 4 rotates around a hinge 4*b*, that is located at the lower edge of the lid 4, and opens the opening 2*a*.

Figure 3:
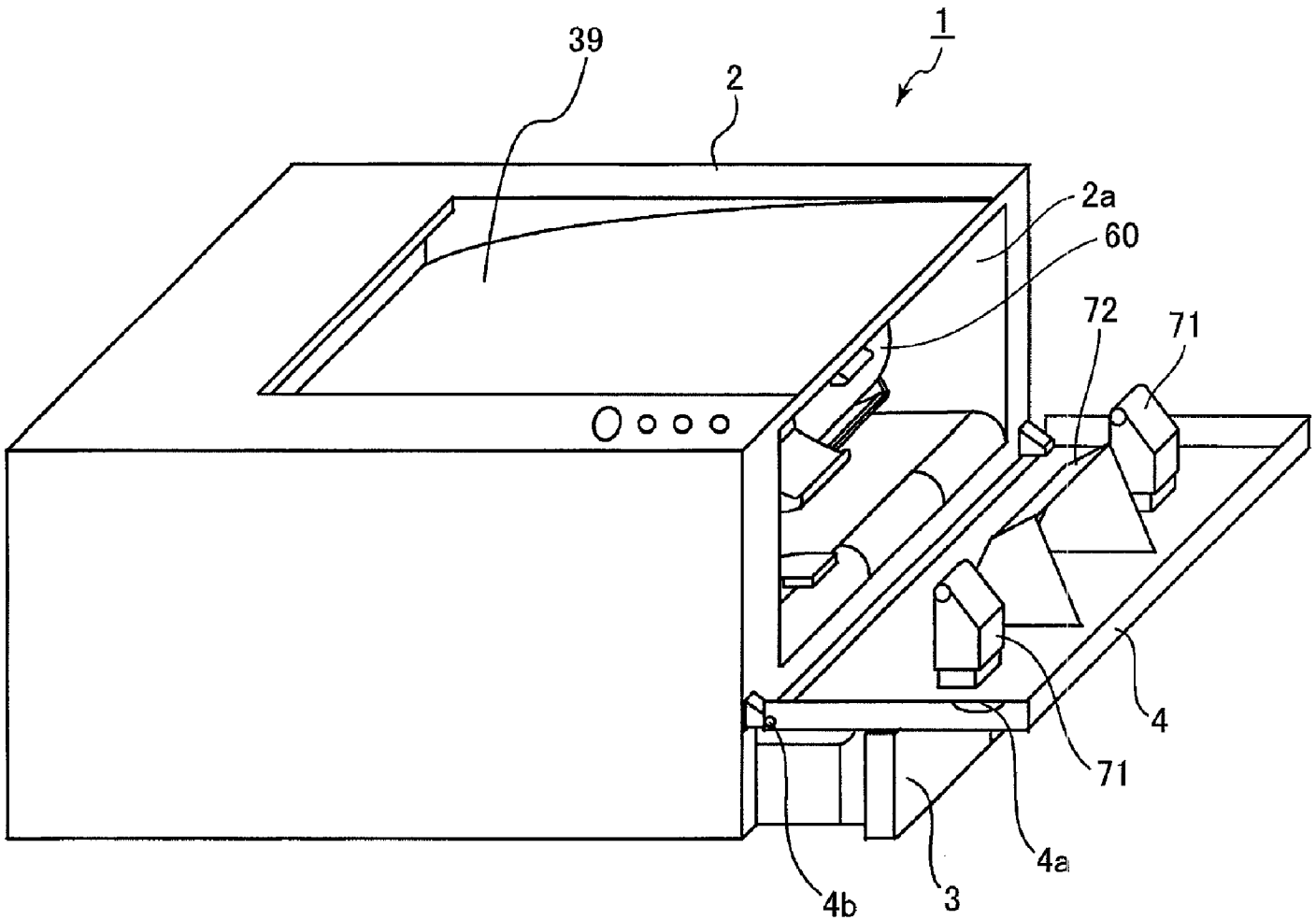
FIG. 3 is a perspective view of the laser printer, illustrating how a sheet cassette is pulled out of the main body of the laser printer.

As shown in FIG. 3, the sheet cassette 3 can be pulled out forwardly from the main body of the laser-printer 1. Thus, the sheet cassette 3 can be removed from the main body of the laser printer 1.

Figure 4:
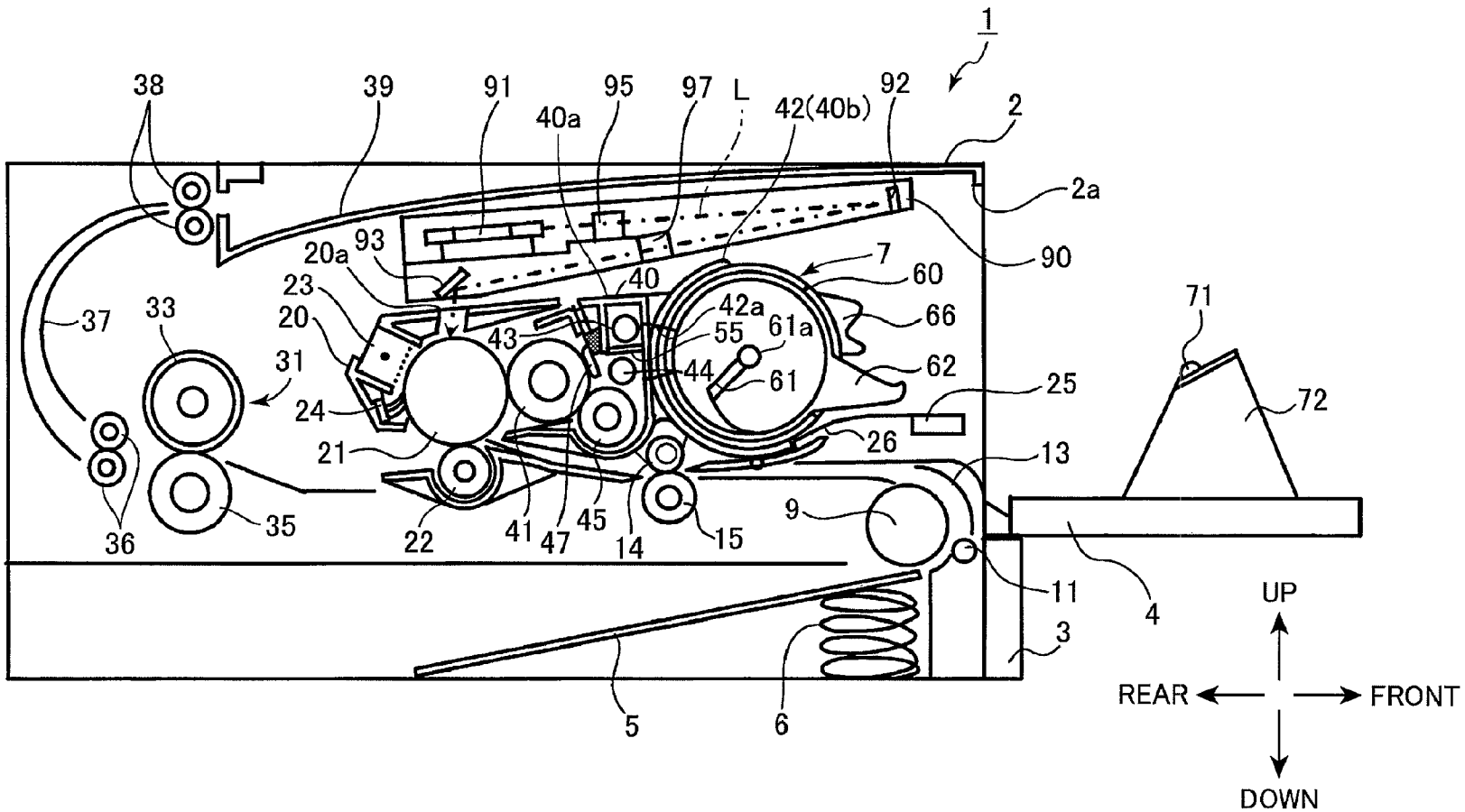
FIG. 4 is a sectional view of the laser printer, taken along a line IV-IV in FIG. 2, showing the internal structure thereof.

As shown in FIG. 4, a spring 6 and a support plate 5 are mounted in the sheet cassette 3. The spring urges the support plate 5 upwardly. A sheet-feeding roller 9 is provided above the front edge of the support plate 5. The sheet-feeding roller 9 is for feeding, one at a time, paper sheets (not shown) that are stuck on the support plate 5 toward an image forming unit 7. Along a sheet conveying path from the sheet-feeding roller 9 to the image forming unit 7, a transport roller 11, a guide 13, and a pair of registration rollers 14 and 15 are arranged in this order. The transport roller 11 cooperates with the sheet-feeding roller 9 to transport paper sheets. The guide 13 receives a paper sheet transported by the transport roller 11 and turns back the sheet by about 180° along the outer circumference of the transport roller 11. The registration rollers 14 and 15 stop rotating at appropriate timings to catch the leading edge of a paper sheet and eliminate a skew of the paper sheet.

The image forming unit 7 includes a photosensitive drum 21 and a transfer roller 22. The photosensitive drum 21 and the transfer roller 22 are mounted in a photosensitive-drum cartridge 20. The transfer roller 22 is opposed to the photosensitive drum 21. A toner image is formed on a paper sheet as the sheet passes through the nip between the photosensitive drum 21 and the transfer roller 22. The paper sheet is then supplied to a fixing unit 31.

In the fixing unit 31, the toner image on the sheet is fixed as the sheet passes through the nip between a heating roller 33 and a pressing roller 35. The sheet, on which the image is now fixed, is transported by a pair of transport rollers 36.

A guide 37 is provided to guide the paper sheet that has been transported by the rollers 36, toward the top of the cover 2. A pair of sheet-discharging rollers 38 discharge the paper sheet onto a sheet tray 39 that is provided on the upper surface of the cover 2.

A scanner unit 90 is provided between the sheet tray 39 and the photosensitive-drum cartridge 20. The scanner unit 90 is for scanning the photosensitive drum 21 with laser beam L.

Next, the image forming unit 7 and the scanner unit 90 will be described in more detail.

The photosensitive drum 21 is rotatably supported in the photosensitive-drum cartridge 20. The photosensitive drum 21 has a photosensitive layer on the circumferential surface thereof. The transfer roller 22, a scorotron charger 23, and a paper-dust recovering brush 24 are also mounted in the photosensitive-drum cartridge 20. The scorotron charger 23 is for electrically charging the surface of the photosensitive drum 21 uniformly. The photosensitive-drum cartridge 20 is formed with an exposure opening 20*a*. The laser beam L emitted from the scanner unit 90 enters the photosensitive-drum cartridge 20 through the exposure opening 20*a*. The laser beam L forms an electrostatic latent image on the photosensitive drum 21.

A leaf spring 26 is provided on the photosensitive-drum cartridge 20 to hold a development cartridge 40 on the photosensitive drum cartridge 20. A handle 25 is provided on the front free end of the leaf spring 26. The development cartridge 40 is detachably mounted on the photosensitive drum cartridge 20. A developing roller 41 is rotatably mounted in the development cartridge 40. The developing roller 41 supplies toner onto the surface of the photosensitive drum 21, thereby developing the electrostatic latent image into a toner image on the photosensitive drum 21. The toner image is then transferred from the photosensitive drum 21 onto the paper sheet when the paper sheet is passing through the nip between the photosensitive drum 21 and the transfer roller 22.

The paper-dust recovering brush 24 is in abutment contact with the surface of the photosensitive drum 21 at its location downstream, in the rotating direction of the photosensitive, drum 21, from the location where the toner image is transferred from the photosensitive drum 21 to the paper sheet. The brush 24 is applied with a positive bias, and removes negatively-charged paper dust from the photosensitive drum 21.

As shown in FIG. 4, the developing roller 41 is rotatably supported in the development cartridge 40. The developing roller 41 is driven by a mechanism (later described), while in contact with the photosensitive drum 21.

More specifically, the development cartridge 40 has a developing section 40*a* and a toner-cartridge holding section 40*b*. In the developing section 40*a*, the developing roller 41, an upper auger roller 43, a lower auger roller 44, toner-supplying roller 45, and a developing blade 47 are mounted in the development cartridge 40.

The development cartridge 40 has a toner-cartridge holder 42 in the toner-cartridge holding section 40*b*.

Figure 7:
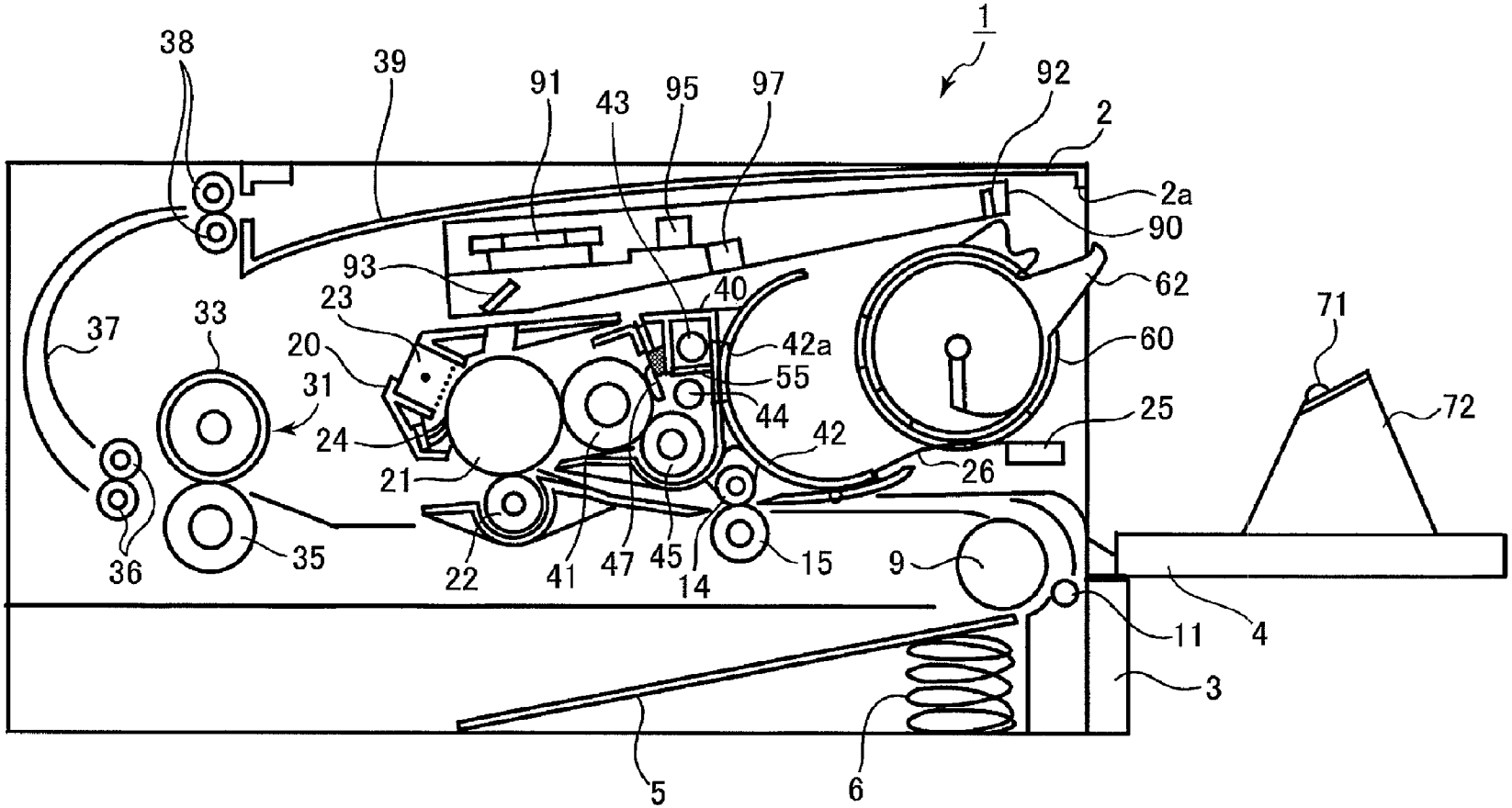
FIG. 7 is a sectional view of the laser printer, illustrating how only the toner cartridge is removed from the main body of the laser printer.

The toner-cartridge holder 42 is of a hollow cylindrical shape that has a peripheral side wall and a pair, of end walls (right-side and left-side end walls), with the front parts of the peripheral side wall and the end walls being opened. The toner-cartridge holder 42 is for detachably supporting a toner cartridge 60 on its inner surface, with the front side of the toner cartridge 60 being exposed. The toner-cartridge holder 42 is formed with an opening 42*a* as shown in FIG. 7. Toner is supplied through the opening 42*a* from the toner cartridge 60 into the developing section 40*a*.

Figure 15:
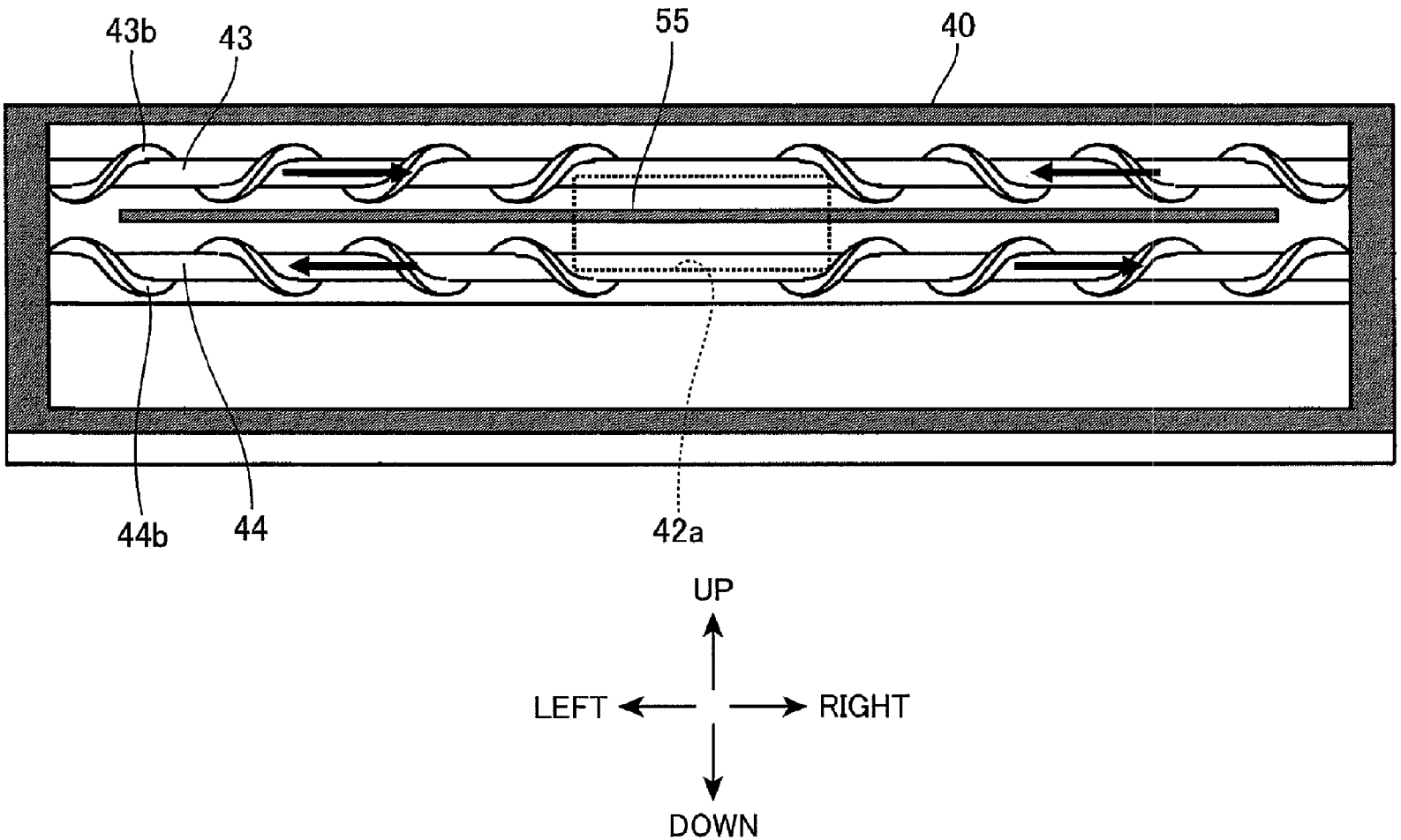
FIG. 15 is a cross-sectional view of the development cartridge, taken along a line in which auger rollers are arranged.

As shown in FIG. 15, the auger rollers 43 and 44 are for receiving toner from the toner cartridge 60 through the opening 42*a*, which confronts the axial middle parts of the auger rollers 43 and 44. The auger rollers 43 and 44 circulate toner along the axial directions thereof between the left and right side ends thereof.

The toner-supplying roller 45 is for receiving toner from the upper and lower auger rollers 43 and 44 and for supplying toner to the developing roller 41. The developing blade 47 is for electrically charging by friction toner that is supplied from the toner-supplying roller 45 onto the surface of the developing roller 41 and for forming a thin layer of toner on the developing roller 41.

An agitator 61 is rotatably supported in the toner cartridge 60. The agitator 61 rotates around its rotational shaft 61*a* to stir the toner in the toner cartridge 60 to supply the toner to the development cartridge 40.

The scanner unit 90 will be described below.

The scanner unit 90 includes a polygon mirror 91, two mirrors 92 and 93, an fθ lens 95, and a cylindrical lens 97. The polygon mirror 91 deflects and scans the laser beam L that is emitted from a laser emitting unit (not shown). The mirrors 92 and 93 reflect the laser beam L, guiding the beam L to the photosensitive drum 21. The fθ lens 95 is located on an optical path that extends from the polygon mirror 91 to the mirror 92. A cylindrical lens 97 is located on another optical path that extends from the mirror 92 to the mirror 93.

The laser unit (not shown) intermittently emits a laser beam L at appropriate timings, while the polygon mirror 91 and the photosensitive drum 21 are being rotated. As a result, an electrostatic latent-image is formed on the surface of the photosensitive drum 21. The developing roller 41 supplies toner to the photosensitive drum 21, thereby developing the electrostatic latent image into a toner image. The toner image is then transferred from the photosensitive drum 21 onto a paper sheet. Thus, an image is formed on the paper sheet according to an electronic photography method.

Figure 5:
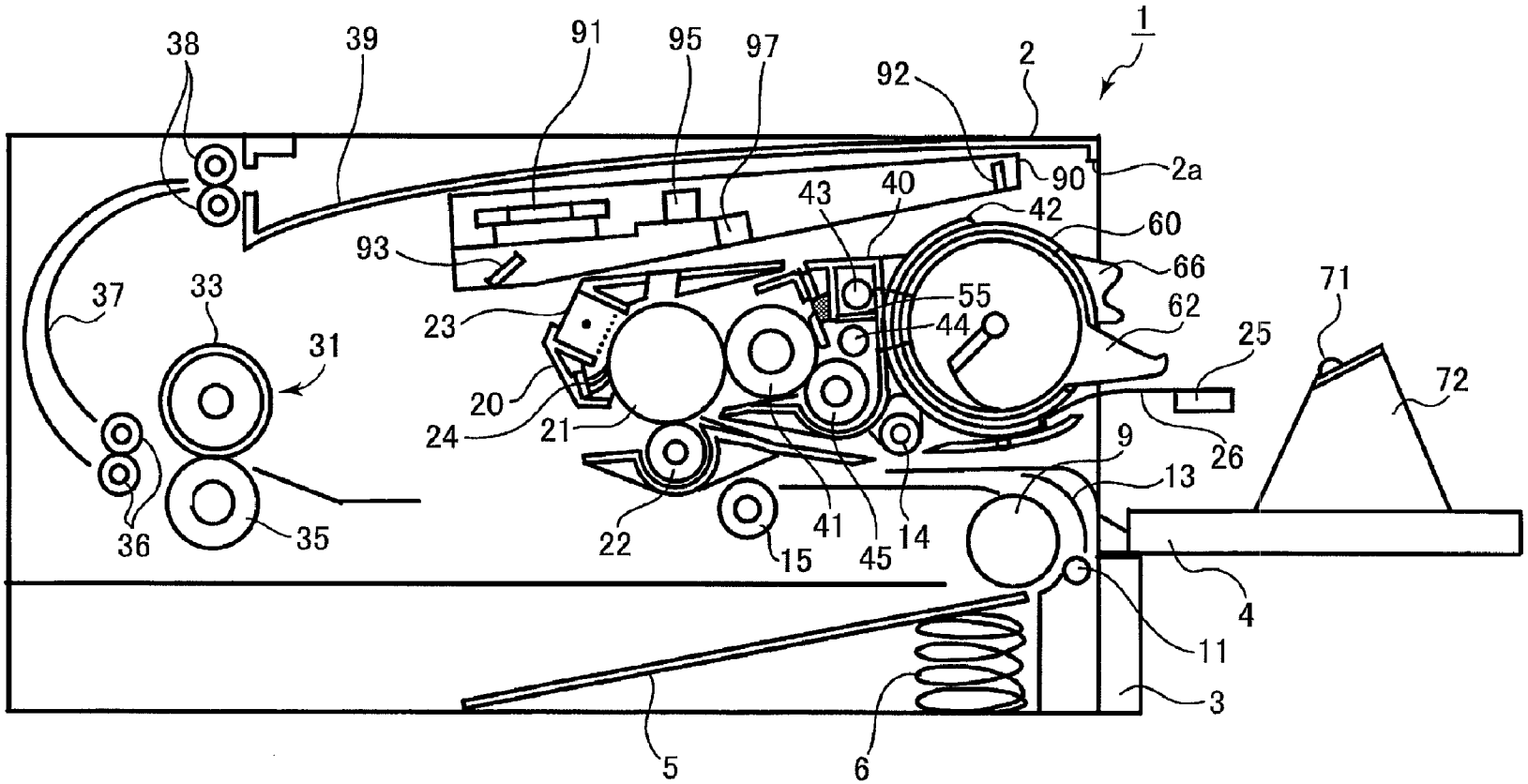
FIG. 5 is a sectional view of the laser printer, illustrating how a photosensitive-drum cartridge, a development cartridge, and a toner cartridge are removed, as an integral unit, from the main body of the laser printer.

As shown in FIG. 5, when the user opens the lid 4 and pulls the handle 25 provided on the photosensitive-drum cartridge 20, the photosensitive-drum cartridge 20 is removed from the main body of the laser printer 1, together with the development cartridge 40 and the toner cartridge 60, through the opening 2*a*.

The toner cartridge 60 has a handle 62. When the user rotates the handle 62 upwards to a disconnecting position shown in FIG. 6, the toner cartridge 60 is disconnected from the development cartridge 40 in a manner described later. The user then pulls the handle 62, whereby only the toner cartridge 60 is removed from the main body of the laser printer 1 through the opening 2*a*, as is illustrated in FIG. 7.

Figure 8:
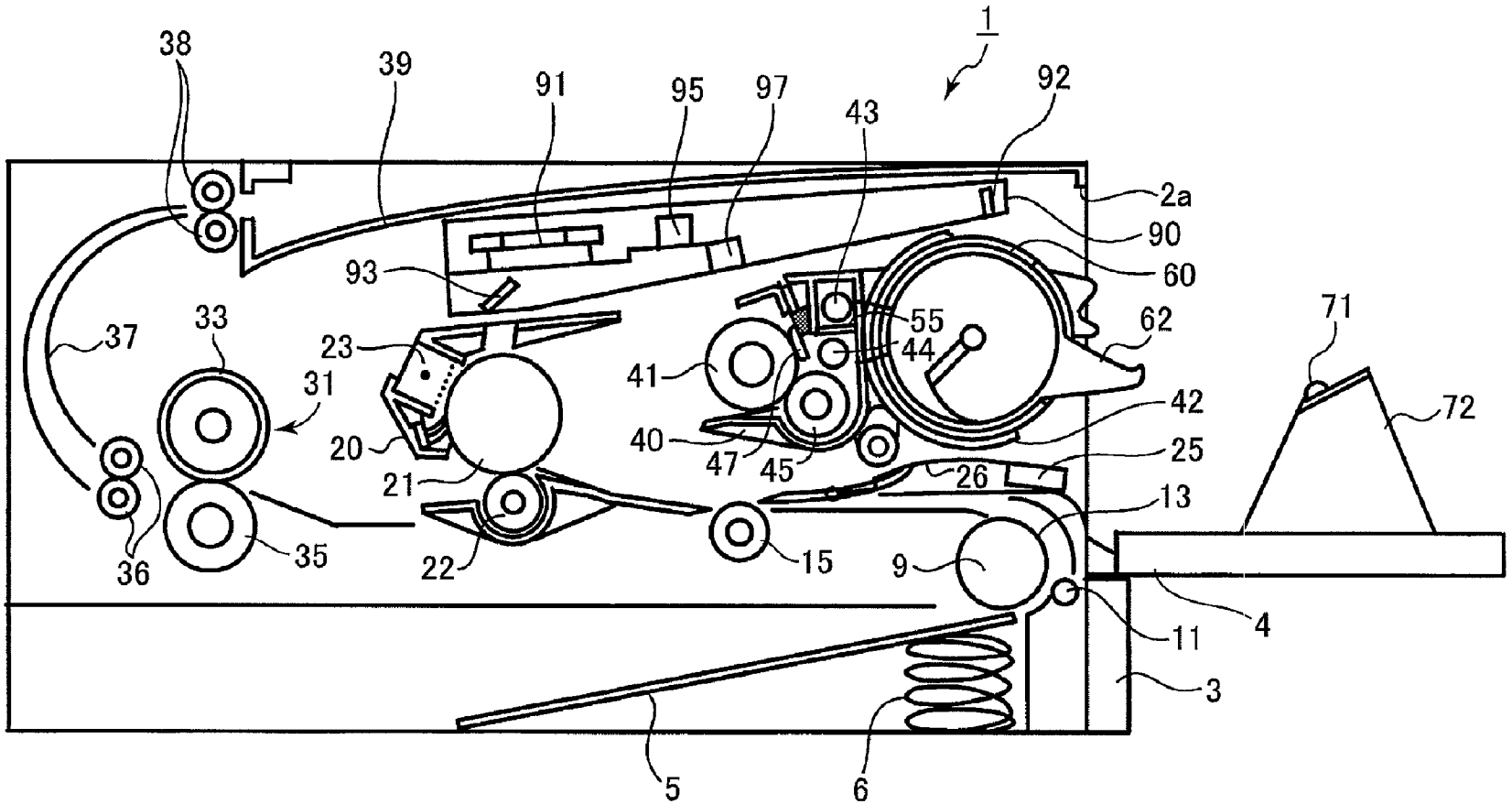
FIG. 8 is a sectional view of the laser printer, illustrating how the development cartridge and the toner cartridge are removed, as an integral unit, from the main body of the laser printer.

As shown in FIG. 8, when the user pushes down the handle 25 on the photosensitive-drum cartridge 20, the leaf spring 26 is pushed down. The user then pulls the handle 62 forwardly without rotating the handle 62 upwards. In this case, the toner cartridge 60 and the development cartridge are detached together, as an integral unit, from the photosensitive-drum cartridge 20 as shown in FIG. 8, and are removed from the main body of the laser printer 1 through the opening 2*a*.

Next, the respective components in the image forming unit 7 will be described in detail.

Figure 9:
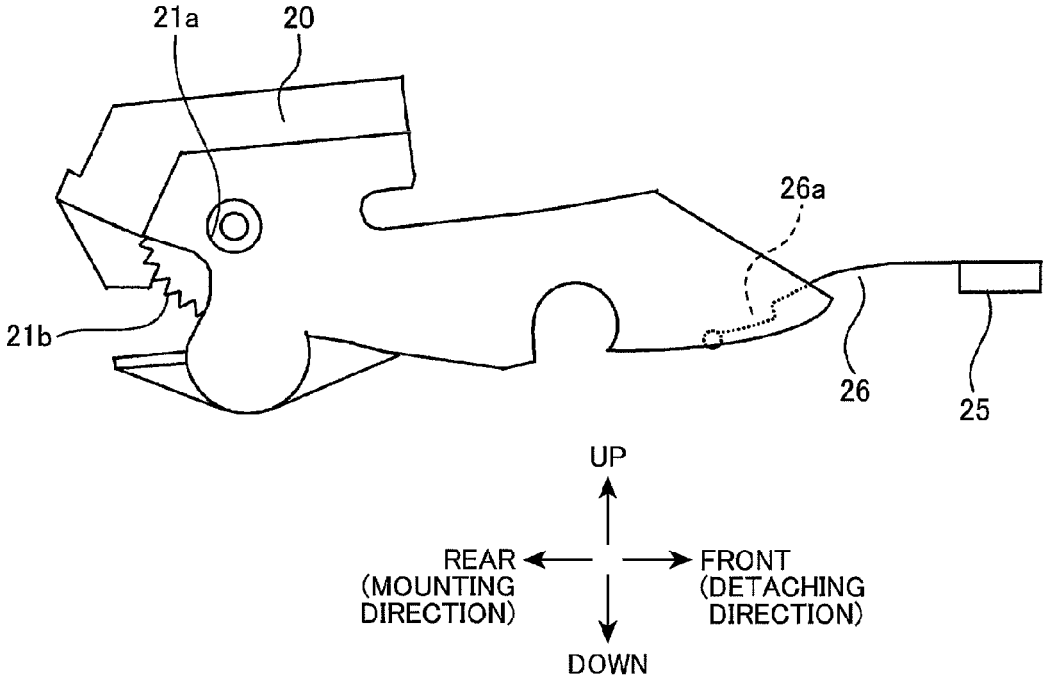
FIG. 9 is a left-side view of the photosensitive-drum cartridge, from which the development cartridge and the toner cartridge are removed.

As described above, the handle 25 is fixedly secured to the photosensitive-drum cartridge 20 via the leaf spring 26. As shown in FIG. 9, the leaf spring 26 is bent upwardly at its midpoint, providing a bent part 26*a* that is shaped like a step. When the development cartridge 40 is mounted on the photosensitive-drum cartridge 20 as shown in FIG. 4, the bent part 26*a* comes into engagement with the lower edge of the toner-cartridge holder 42, as a result of which the development cartridge 40 is coupled to the photosensitive-drum cartridge 20. When the handle 25 is pushed down as described above (see FIG. 8), the bent part 26*a* disengages from the lower edge of the toner-cartridge holder 42. Hence, the development cartridge 40 can be coupled to, and disconnected from, the photosensitive-drum cartridge 20.

As shown in FIG. 9, the photosensitive drum 21 has a metal rotational shaft 21*a*, which projects outwardly from both of the left and right sides of the photosensitive-drum cartridge 20. A gear 21*b* is provided on the left-side end of the photosensitive drum 21. The gear 21*b* rotates integrally with the photosensitive drum 21. The gear 21*b* protrudes from the rear end of the photosensitive-drum cartridge 20.

Figure 10:
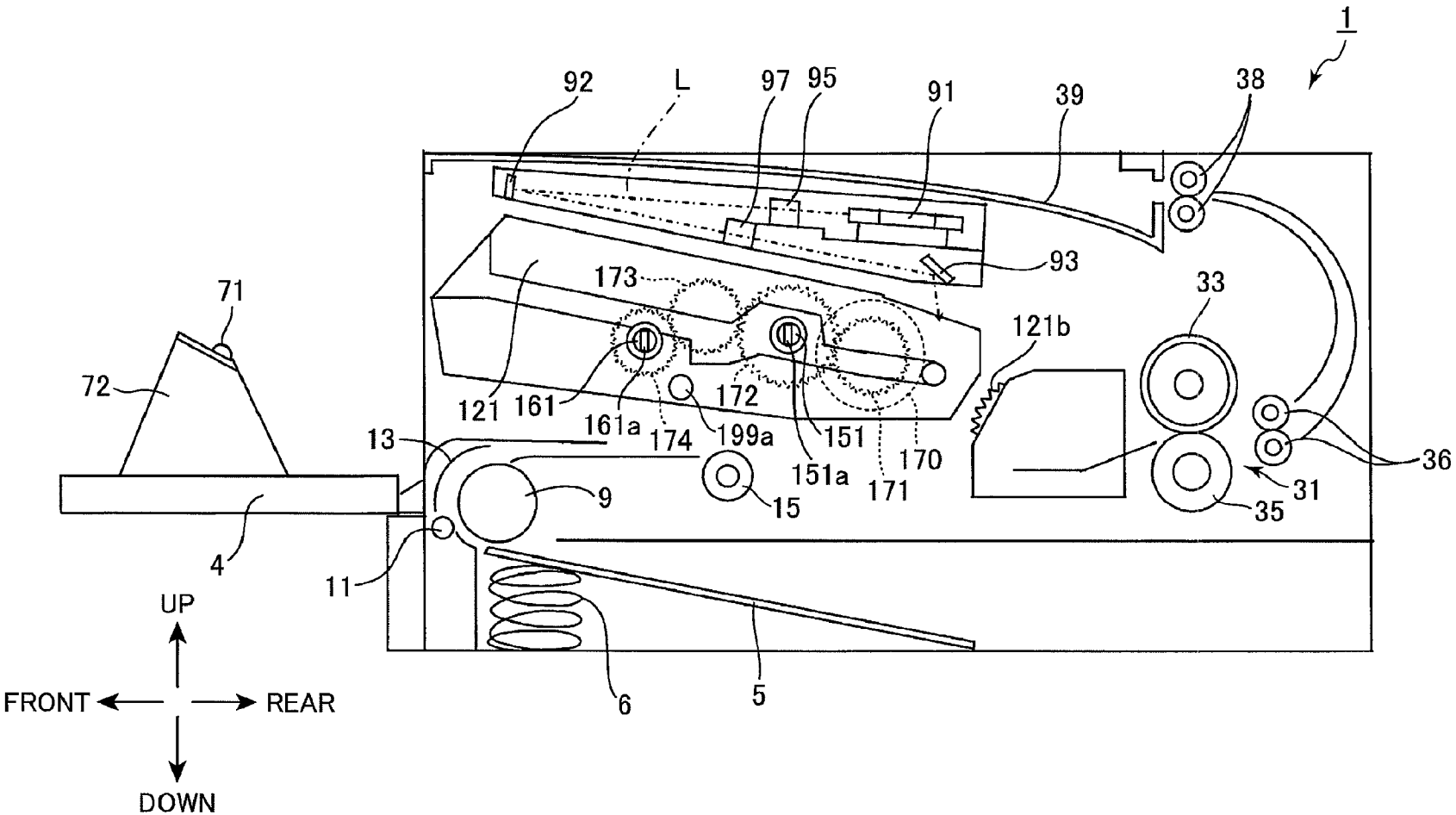
FIG. 10 shows the configuration on the inner surface of a left-side wall in the main body of the laser printer.

As shown in FIG. 10, a guide groove 121 is formed on the inner surface of the left-side wall in the main body of the laser printer 1. The guide groove 121 is for guiding the rotational shaft 21*a* of the photosensitive drum 21. A gear 121*b* is provided in the main body of the laser printer 1. The gear 121*b* can be driven by a drum motor 122 (see FIG. 16). When the photosensitive-drum cartridge 20 is set in position in the main body of the laser printer 1, the gear 121*b* is in engagement with the gear 21*b*. Accordingly, a drive force is transmitted from the main body of the laser printer 1 to the photosensitive drum 21.

Figure 11:
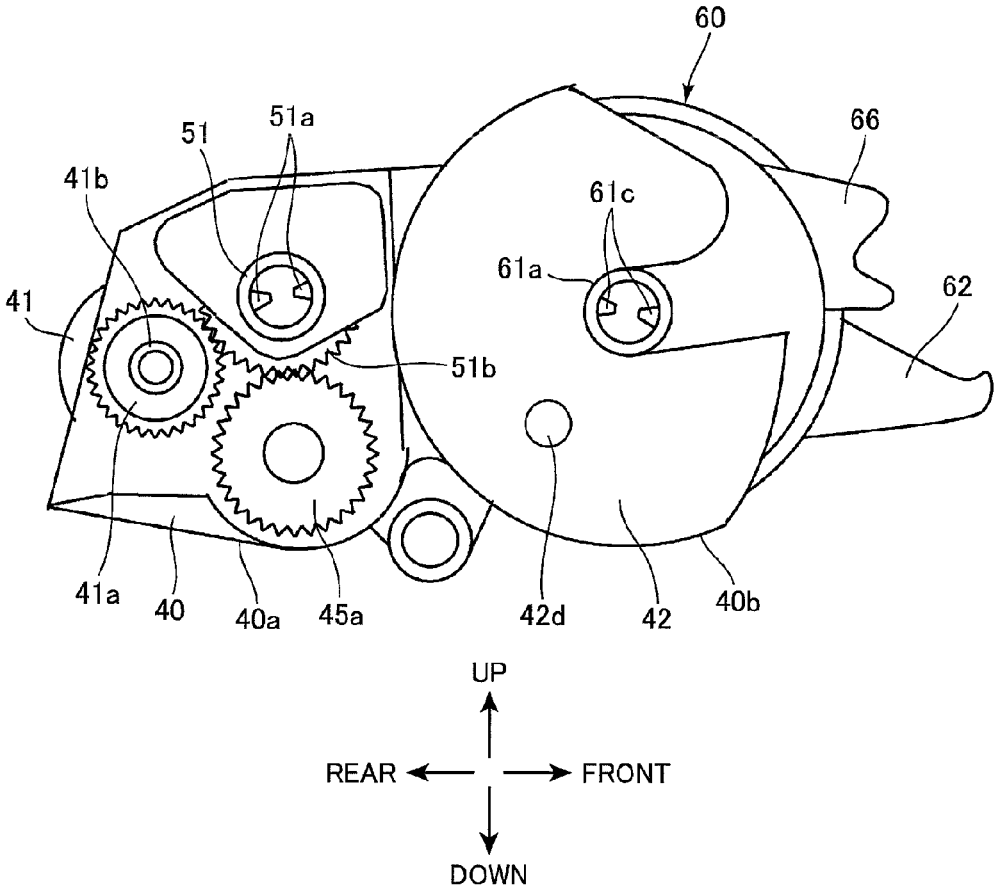
FIG. 11 is a left-side view showing the toner cartridge and the development cartridge when they are coupled with each other.

As shown in FIG. 11, a drive shaft 51 is provided on the left side of the development cartridge 40 at the developing section 40*a*. The drive shaft 51 is for receiving a drive force from a drive shaft 151, which is provided on the inner surface of the left-side wall in the main body of the laser printer 1 as shown in FIG. 10. The drive shaft 151 has a plate-shaped projection 151*a* on its axial tip end. The drive shaft 51 has: a hollow cylindrical portion at its axial tip end; and a pair of projections 51*a* that are provided within the hollow cylindrical portion. The pair of projections 51*a* can engage with the plate-shaped projection 151*a* of the drive shaft 51. Thus, the drive shaft 151 can be fitted in the drive shaft 51. The drive shafts 51 and 151 constitute a so-called drive coupling.

As shown in FIG. 11, a gear 51*b* is fixedly mounted on the drive shaft 51. The gear 51*b* is located on the outer surface of the left-side wall of the development cartridge at the developing section 40*a*. The gear 51*b* rotates integrally with the drive shaft 51.

A rotational shaft 41*b* of the developing roller 41 and a rotational shaft of the toner-supplying roller 45 protrude outwardly from the left-side wall of the development cartridge 40. A gear 41*a* is fixed on the left-side end of the rotational shaft 41*b*, and rotates integrally with the developing roller 41. A gear 45*a* is fixed on the left-side end of the rotational shaft of the toner-supplying roller 45, and rotates integrally with the toner-supplying roller 45. Thus, the gears 41*a* and 45*a* are located on the outer surface of the left-side wall of the development cartridge 40 at the developing section 40*a*. The gear 51*b* is in engagement with both of the gear 41*a* and the gear 45*a*.

Figure 12A:
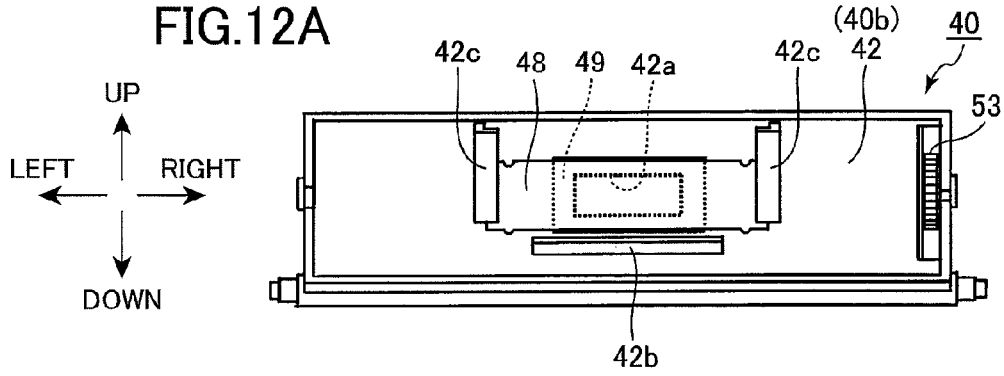
FIG. 12A is a front view of a toner-cartridge holder in the development cartridge as viewed from the toner cartridge side when the toner cartridge is disconnected from the development cartridge.
Figure 12B:
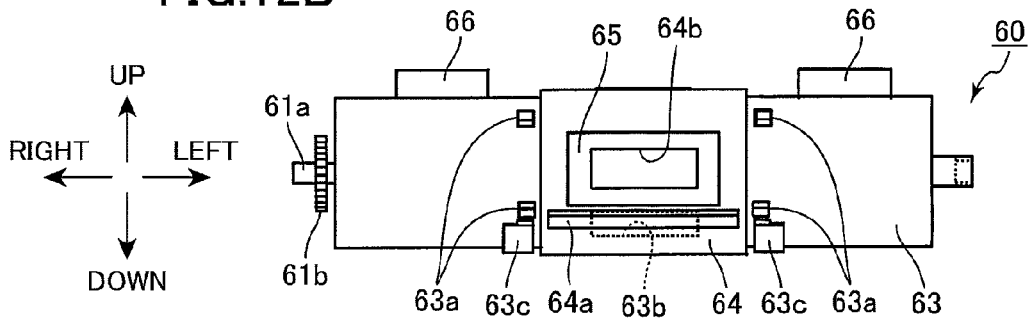
FIG. 12B is a rear view of the toner cartridge as viewed from the toner-cartridge holder side when the toner cartridge is disconnected from the development cartridge.

The toner cartridge 60 can be connected to and disconnected from the development cartridge 40. FIGS. 12A and 12B show the state where the toner cartridge 60 is disconnected from the development cartridge 40, that is, the handle 62 of the cartridge 60 has been rotated upwards to the disconnecting position as of FIG. 6. FIG. 12A shows the toner-cartridge holder 42 in the development cartridge 40, as viewed from the toner cartridge 60 side, and FIG. 12B shows the toner cartridge 60 as Viewed from the toner-cartridge holder 42 side.

As shown in FIG. 12B, the toner cartridge 60 has an inner cylinder 63 and an outer cylinder 64.

The inner cylinder 63 is a longitudinal hollow cylinder that has a peripheral side wall and a pair of opposite end walls (right-side and left-side end walls). The inner cylinder 63 contains toner therein. The rotational shaft 61*a* of the agitator 61 extends along the central axis of the inner cylinder 63. The rotational shaft 61*a* protrudes outwardly from the pair of opposite end walls (right-side and left-side end walls) of the inner cylinder 63. A gear 61*b* is provided on the right-side end of the rotational shaft 61*a* and is therefore located on the outer side of the right-side end wall of the inner cylinder 63. The gear 61*b* rotates integrally with the rotational shaft 61*a*.

The outer cylinder 64 is coaxial with the inner cylinder 63 and surrounds the axial central part of the inner cylinder 63. The inner and outer cylinders 63 and 64 are supported by the cylindrical toner-cartridge holder 42 coaxially.

The outer cylinder 64 has an elongated projection 64*a* on its outer peripheral surface. The elongated projection 64*a* projects toward the inner peripheral surface of the toner-cartridge holder 42. The toner-cartridge holder 42 has an elongated groove 42*b* on its inner peripheral surface. The outer cylinder 64 is supported by the toner-cartridge holder 42, with the projection 64*a* being fitted in the elongated groove 42*b*. Hence, the outer cylinder 64 is fixedly secured to the toner-cartridge holder 42 and cannot rotate relative to the outer cylinder 64.

The handle 62 is formed integrally with the inner cylinder 63. The inner cylinder 63 can rotate around its central axis relative to the outer cylinder 64 when the user operates the handle 62 to move the handle 62 upwardly or downwardly.

Figure 12C:
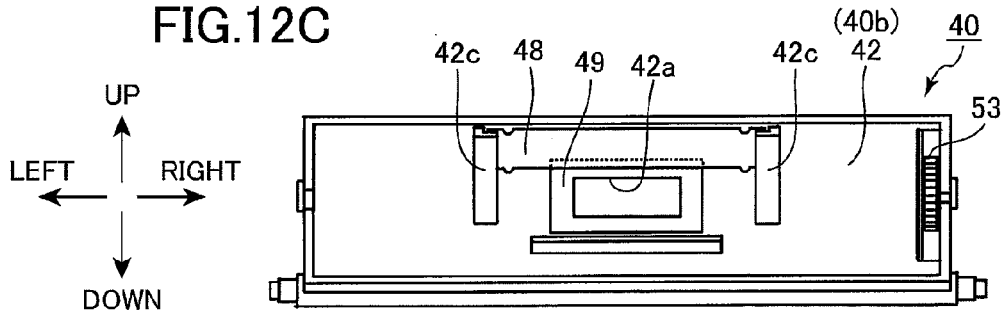
FIG. 12C is a front view of the toner-cartridge holder in the development cartridge as viewed from the toner cartridge side when the toner cartridge is coupled to the development cartridge.

As shown in FIG. 12A, a pair of rails 42*c* are provided on the inner peripheral surface of the toner-cartridge holder 42. A shutter 48 made of metal is slidably mounted on the pair of rails 42*c* at its pair of opposite ends. The shutter 48 is of a rectangular shape that is elongated in the axial direction of the toner-cartridge holder 42. The shutter 48 can move along the circumference of the cylindrical toner-cartridge holder 42, between the closing position where the shutter 48 closes the opening 42*a* as shown in FIG. 12A and the opening position where the shutter 48 is shifted upwardly from the opening 42*a* to expose the opening 42*a* as shown in FIG. 12C.

Two pairs of projections 63*a* are provided on the outer peripheral surface of the inner cylinder 63. The two pairs of projections 63*a* are separate from each other in the circumferential direction of the inner cylinder 63 as sandwiching the shutter 48 therebetween. Two projections 63*a* constituting each pair are separate from each other in the axial direction of the inner cylinder 63 and confront the two opposite longitudinal ends of the shutter 48. As the inner cylinder 63 rotates, the two pairs of projections 63*a* move the shutter 48 while holding it therebetween in the circumferential direction along the inner peripheral surface of the toner-cartridge holder 42. When the handle 62 is rotated to the disconnecting position shown in FIG. 6, the shutter 48 closes the opening 42*a* as shown in FIG. 12A.

The elongated groove 42*b* is located on the inner peripheral surface of the toner-cartridge holder 42 at a position below the shutter 48 and not overlapping the shutter 48 even when the shutter 48 is moved to its lowest position shown in FIG. 12A to completely close the opening 42*a*.

The opening 42*a* is of a rectangular shape that is elongated in the axial direction of the toner-cartridge holder 42. A sponge member 49 in a rectangular frame shape is bonded to the inner peripheral surface of the toner-cartridge holder 42 around the opening 42*a*.

A pair of engagement members 63*c* are formed on the outer peripheral surface of the inner cylinder 63 integrally with the inner cylinder 63. The pair of engagement members 63*c* are provided on the inner cylinder 63 at such locations that the engagement members 63*c* can engage with the pair of rails 42*c* when the handle 62 of the inner cylinder 63 is in a coupling position shown in FIG. 4. It is noted that each rail 42*c* has an L-shaped cross-section, while each engagement member 63*c* has a cross-sectional shape that can be engaged with the L-shaped cross-section of the corresponding rail 42*c*.

The outer cylinder 64 is formed with an opening 64*b* that has the same shape as the opening 42*a*. The opening 64*b* is provided in the outer cylinder 64 at such a position that the opening 64*b* will confront the opening 42*a* when the outer cylinder 64 is mounted in the toner-cartridge holder 42 with the elongated projection 64*a* being fitted in the elongated groove 42*b*. A sponge member 65 in the same shape with the sponge member 49 is bonded to the outer peripheral surface of the outer cylinder 64 around the opening 64*b*.

The inner cylinder 63 is formed with an opening 63*b* that has the same shape with the opening 64*b*. As shown in FIG. 12B, the openings 64*b* and 63*b* do not overlap with each other when the handle 62 is in the disconnecting position of FIG. 6. This ensures that toner will not come out from the toner cartridge 60 when the toner cartridge 60 is removed from the development cartridge 40 as shown in FIG. 7.

Figure 6:
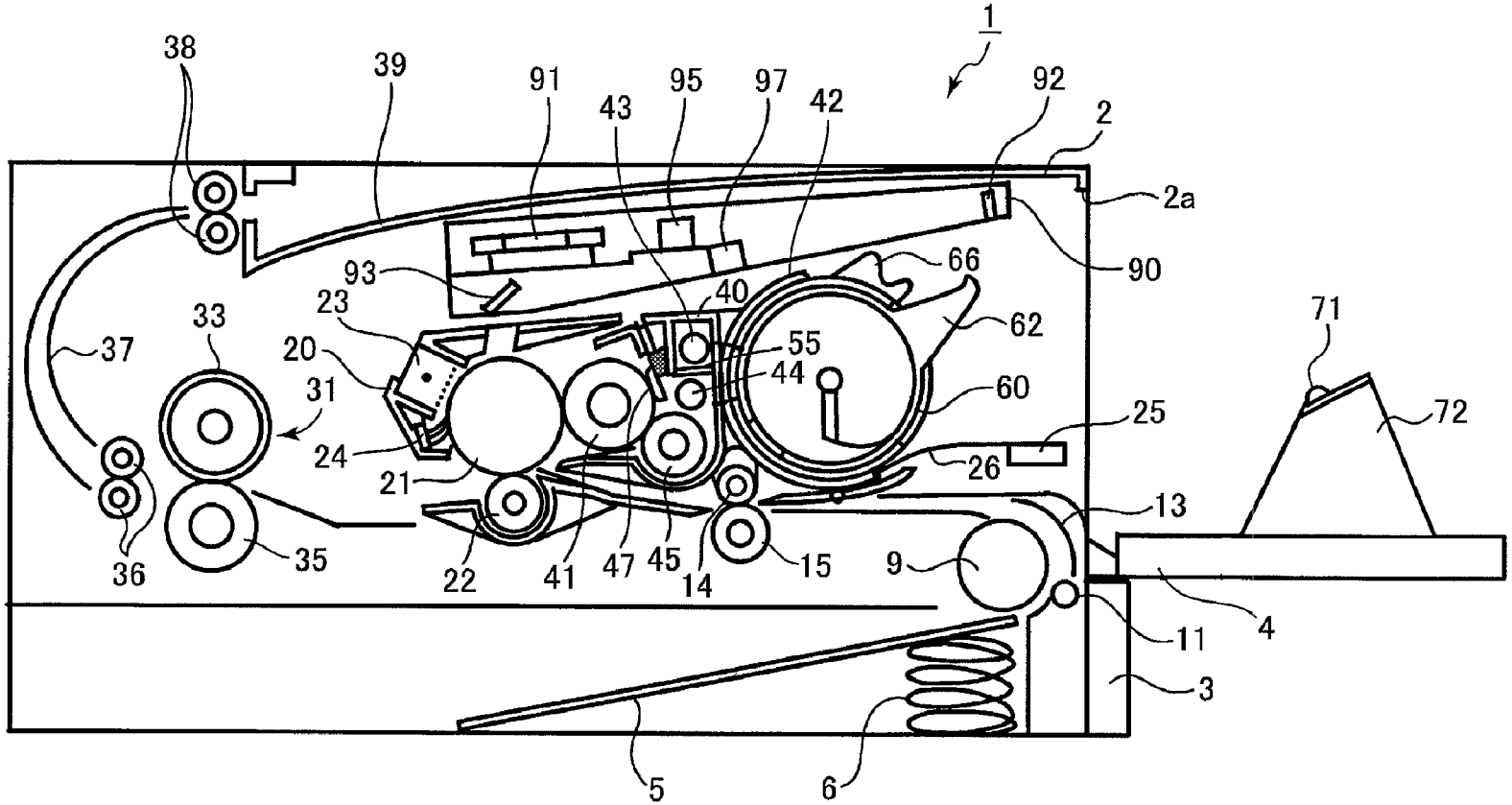
FIG. 6 is a sectional view of the laser printer, illustrating how the toner cartridge is disconnected from the development cartridge.
Figure 12D:
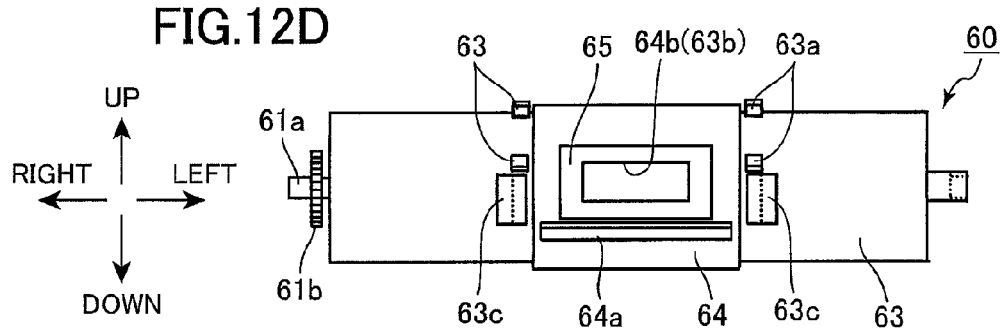
FIG. 12D is a rear view of the toner cartridge as viewed from the toner-cartridge holder side when the toner cartridge is coupled to the development cartridge.

The handle 62 of the toner cartridge 60 can be rotated from the disconnecting position of FIG. 6 downwards to the coupling position shown in FIG. 4, while maintaining the projection 64*a* to be fitted in the elongated groove 42*b*. As a result, the openings 64*b* and 63*b* become overlapping with each other as shown in FIG. 12D, and the projections 63*a* push up the shutter 48 from the opening 42*a* as shown in FIG. 12C. As a result, the inside of the inner cylinder 63 is brought into fluid communication with the inside of the developing section 40*a* of the development cartridge 40. Toner can therefore be supplied from the toner cartridge 60 to the developing section 40*a* in the development cartridge 40.

At this time, the sponge members 49 and 65 come into firm contact with each other, and the engagement members 63*c* are engaged with the rails 42*c*. Accordingly, the entire periphery of the openings 64*b* and 42*a* are tightly sealed, allowing no toner to come outside. When the engagement members 63*c* are thus engaged with the rails 42*c*, the development cartridge 40 and the toner cartridge 60 are coupled to each other as shown in FIG. 4. Accordingly, the cartridges 40 and 60 can be removed and inserted, as an integral unit, from and onto the photosensitive-drum cartridge 20 as shown in FIG. 8. Thus, the cartridges 40 and 60 can be removed and inserted, as an integral unit, from and into the main body of the laser printer 1 as shown in FIG. 8.

The handle 62 may be operated to rotate the inner cylinder 63 to release the engagement members 63*c* from the rails 42*c*. Thus, the development cartridge 40 and the toner cartridge 60 can be disconnected from each other. Accordingly, only the toner cartridge 60 can be removed from the laser printer 1 as shown in FIG. 7.

Figure 13:
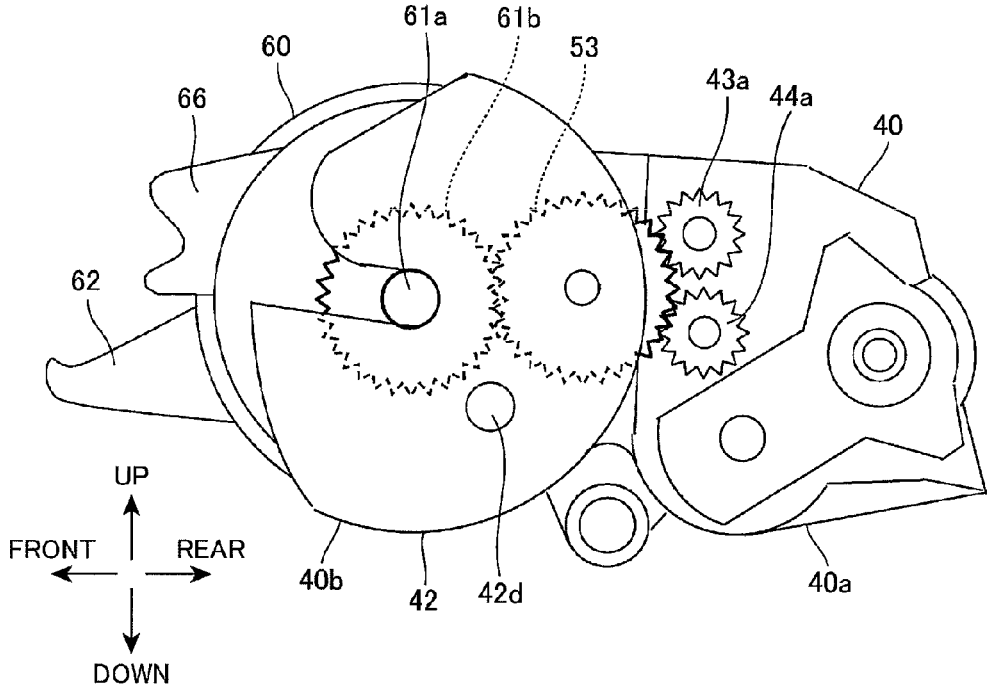
FIG. 13 is a right-side view showing the toner cartridge and the development cartridge when they are coupled with each other.

As shown in FIG. 12A and FIG. 13, a gear 53 is mounted on the inner side of the right-side end wall of the toner-cartridge holder 42. The gear 53 is engaged with the gear 61*b* when the toner cartridge 60 is set in the toner-cartridge holder 42.

As shown in FIG. 15, the upper auger roller 43 and the lower auger roller 44 protrude outwardly from, the right-sides wall of the development cartridge 40. As shown in FIG. 13, gears 43*a* and 44*a* are attached to the right-side ends of the upper auger roller 43 and the lower auger roller 44, respectively. Accordingly, the gears 43*a* and 44*a* are located on the outer surface of the right-side wall of the development cartridge 40. The gears 43*a* and 44*a* rotate integrally with the upper auger roller 43 and the lower auger roller 44, respectively. The gear 53 is in engagement with both of the gears 43*a* and 44*a*. It is noted that the components, such as the gears 43*a* and 44*a*, that are arranged outside the development cartridge 40 are not illustrated in FIG. 15 for clarity purpose.

As shown in FIG. 10, a drive shaft 161 is provided on the inner surface of the left-side wall in the main body of the printer 1. The drive shaft 161 and the rotational shaft 61*a* of the agitator 61 shown in FIG. 11 constitute a so-called drive coupling. More specifically, the drive shaft 161 has a plate-shaped projection 161*a* on its axial tip end. The rotational shaft 61*a* has a hollow cylindrical portion at its left-side axial tip end, and a pair of projections 61*c* provided within the hollow cylindrical portion. The pair of projections 61*c* can engage with the plate-shaped projection 161*a* of the drive shaft 161. Thus, the drive shaft 161 can be fitted in the rotational shaft 61*a*.

The agitator 61 is rotated when a drive force is transmitted to the rotational shaft 61*a* from the drive shaft 161. The drive force is transmitted from the gear 61*b* to the gear 53, and then from the gear 53 to the gears 43*a* and 44*a*. As a result, the auger rollers 43 and 44 are rotated.

As shown in FIG. 10, a gear 171 is fixedly secured to the rotary shaft of a development motor 170, and rotates integrally with the rotary shaft of the development motor 170. A gear 172 is provided in engagement with the gear 171.

Figure 16:
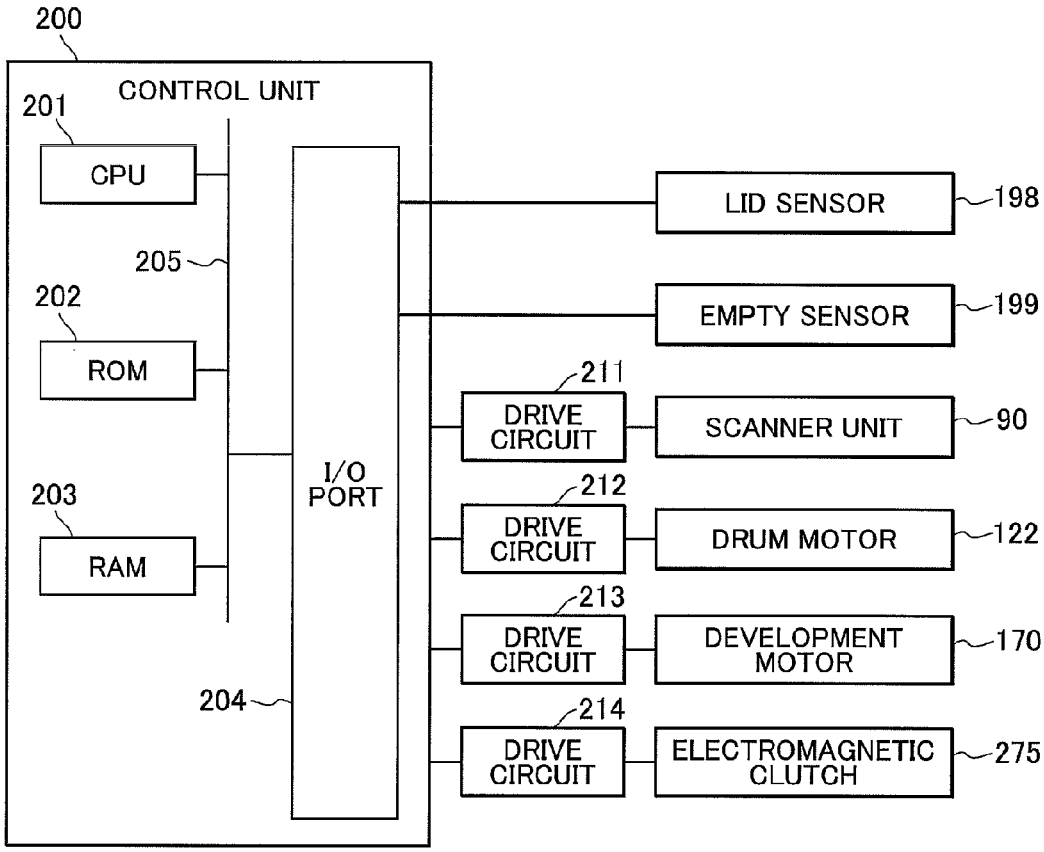
FIG. 16 is a block diagram illustrating the configuration of the control system incorporated in the laser printer.

An electromagnetic clutch 275 is provided as shown in FIG. 16 to connect and disconnect the drive shaft 151 to and from the gear 172. When the electromagnetic clutch 275 is in a coupling state to connect the drive shaft 151 to the gear 172, the drive shaft 151 rotates integrally with the gear 172. When the electromagnetic clutch 275 is in a disconnecting state to disconnect the drive shaft 151 from the gear 172, the drive shaft 151 does not rotate even when the gear 172 rotates.

A gear 174 is fixedly secured to the drive shaft 161, and the gear 174 rotates integrally with the drive shaft 161. A gear 173 is provided in engagement with both of the gears 172 and 174. Thus, the gear 174 is engaged with the gear 172 via the gear 173.

When the electromagnetic clutch 275 is switched into the coupling state, the drive force of the development motor 170 is outputted from both of the drive shafts 151 and 161 to the cartridges 40 and 60. As a result, the developing roller 41, toner-supplying roller 45, upper auger roller 43, lower auger roller 44 and agitator 61 are driven. On the other hand, when the electromagnetic clutch 275 is switched into the disconnecting state, the drive force of the development motor 170 is outputted to the drive shaft 161 only. In this case, the upper auger roller 43, lower auger roller 44 and agitator 61 are driven, while the developing roller 41 and the toner-supplying roller 45 remain stopped.

The drive shafts 151 and 161 are provided on the left-side wall in the main body of the laser printer 1 as being capable of protruding and retracting together. More specifically, the drive shafts 151 and 161 are connected to a link mechanism (not shown), and protrude when the lid 4 is closed and retract when the lid 4 is opened. When the lid 4 is opened, the drive shafts 151 and 161 are brought out of engagement from the drive shaft 51 and rotational shaft 61*a*, respectively. Thus, the photosensitive-drum cartridge 20, development cartridge 40 and toner cartridge 60 can be removed from the main body of the laser printer 1. On the other hand, when the lid 4 is closed, the drive shafts 151 and 161 are brought into engagement with the drive shaft 51 and rotational shaft 61*a*, respectively. As a result, the above-described various components can be driven.

The agitator 61 will be described in greater detail with reference to FIG. 14.

The agitator 61 is made of resin having flexibility, such as ABS resin, and is constituted by the following parts that are formed integral with one another. That is, the agitator 61 includes the rotational shaft 61*a*, the gear 61*b* (FIG. 13), a blade member 61*d*, a flexible film member 61*e*, and pair of wiper-supporting parts 61*f*, all formed integral with one another. The blade member 61*d* is secured to the shaft 61*a*. The film member 61*e* is secured to the blade member 61*d*. The wiper-supporting parts 61*f* are secured to the shaft 61*a*.

The wiper-supporting parts 61*e* project from a pair of opposite axial ends (right-side and left-side axial ends) of the rotational shaft 61*a*, respectively, in a direction opposite to a direction in which the blade member 61*d* projects. As will be described below, a pair of toner-amount detecting windows 63*d* are provided on the pair of opposite side end walls (right-side and left-side end walls) of the inner cylinder 63. One wiper member 67 is fixed to each wiper-supporting part 61*f* and is in resilient contact with the inner surface of the corresponding end wall (right-side or left-side end wall) of the inner cylinder 63 and can therefore wipe the toner-amount detecting window 63*d* on the corresponding end wall.

It is noted that the pair of toner-amount detecting windows 63*d* are formed in the rear-and-lower portions in the left and right-side end walls of the inner cylinder 63, respectively. The pair of windows 63*d* oppose each other. As shown in FIGS. 11 and 13, the toner-cartridge holder 42 is formed with a pair of circular light-transmitting through-holes 42*d*. The pair of circular light-transmitting through-holes 42*d* are formed through the right-side and left-side end walls of the toner-cartridge holder 42, respectively, opposing the toner-amount detecting windows 63*d*.

As shown in FIG. 15, the upper auger roller 43 and lower auger roller 44 have spiral blades 43*b* and 44*b*, respectively. When the agitator 61 is driven, the lower auger roller 44 transports toner from the opening 42*a* to the left and right sides of the development cartridge 40, and the upper auger roller 43 transports toner from the left and right sides of the development cartridge 40 back to the middle part of the cartridge 40, as indicated by arrows in the figure. The toner can therefore be recovered from the right and left sides of the development cartridge 40 to the middle part thereof and returned back to the toner cartridge 60 through the opening 42*a*.

Therefore, the upper auger roller 43, lower auger roller 44 and agitator 61 can circulate the toner not only between the development cartridge 40 and the toner cartridge 60, but also in the development cartridge 40. This prevents degraded toner from coagulating at a particular position, from forming a hard mass, and from being firmly adhered thereto, to thereby maintain the fluidity of the toner.

Figure 14:
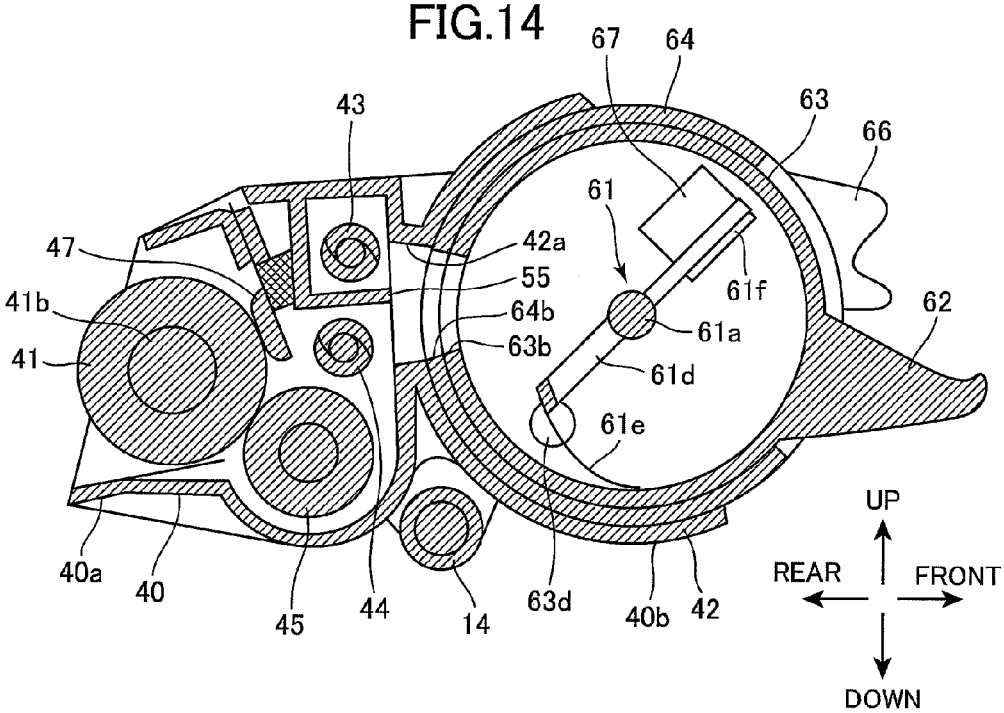
FIG. 14 is a sectional view illustrating the inner structures of the toner cartridge and development cartridge when they are coupled with each other.

As shown in FIGS. 14 and 15, a partition wall 55 is provided in the development cartridge 40 at a location between the upper auger roller 43 and the lower auger roller 44. The partition wall 55 helps to transport toner smoothly.

As shown in FIGS. 12B and 14, a pair of spring receptacles 66 are provided on the outer surface of the inner cylinder 63. The spring receptacles 66 are located slightly above the left- and right-side ends of the handle 62. Each spring receptacle 66 has a recess in the middle part in the circumferential direction of the cylinder 63. As shown in FIG. 2, a pair of pushing members 71 project from the rear surface of the lid 4. Each pushing member 71 is urged in its protruding direction by a spring (not shown) that is installed in the pushing member 71. The spring receptacles 66 receive the pushing force from the pushing members 71 when the lid 4 is closed. The pushing force reliably holds the cartridges 20, 40 and 60 in their mounting positions.

An interference member 72 also protrudes from the rear surface of the lid 4 at a location between the pair of pushing members 71. The interference member 72 interferes with the handle 62 unless the handle 62 is placed at the coupling position shown in FIG. 4. Hence, the lid 4 cannot be closed until the handle 62 is properly placed at the coupling position.

The laser printer 1 has a control system, which will be described below with reference to FIG. 16.

As shown in FIG. 16, the laser printer 1 has a lid sensor 198 and an empty sensor 199. The lid sensor 198 is, for example, a limit switch and detects whether the lid 4 has been opened or closed. The empty sensor 199 is, for example, a photocoupler that optically detects whether toner remains in the toner cartridge 60 through the toner-amount detecting windows 63*d* and the light-transmitting through-holes 42*d*. In this example, the empty sensor 199 includes a light-emitting element 199*a* and a light-receiving element (not shown). As shown in FIG. 10, the light-emitting element 199*a* is provided on the inner surface of the left-side wall in the main body of the laser printer 1. Although not shown, the light-receiving element is provided on the inner surface of the right-side wall in the main body of the laser printer 1.

The control unit 200 of the laser printer 1 is a microcomputer of a known type that includes a CPU 201, a ROM 202, a RAM 203, an I/O port 204, and a bus 205. The bus 205 connects the components 201, 202, 203 and 204 to one another. The I/O port 204 receives signals from the lid sensor 198 and empty sensor 199. To the I/O port 204, there are connected the scanner unit 90, the drum motor 122, the development motor 170 and the electromagnetic clutch 275 via drive circuits 211, 212, 213 and 214, respectively. Various mechanisms of known types, such as an operation panel and a buzzer, are also connected to the I/O port 204.

Figure 17:
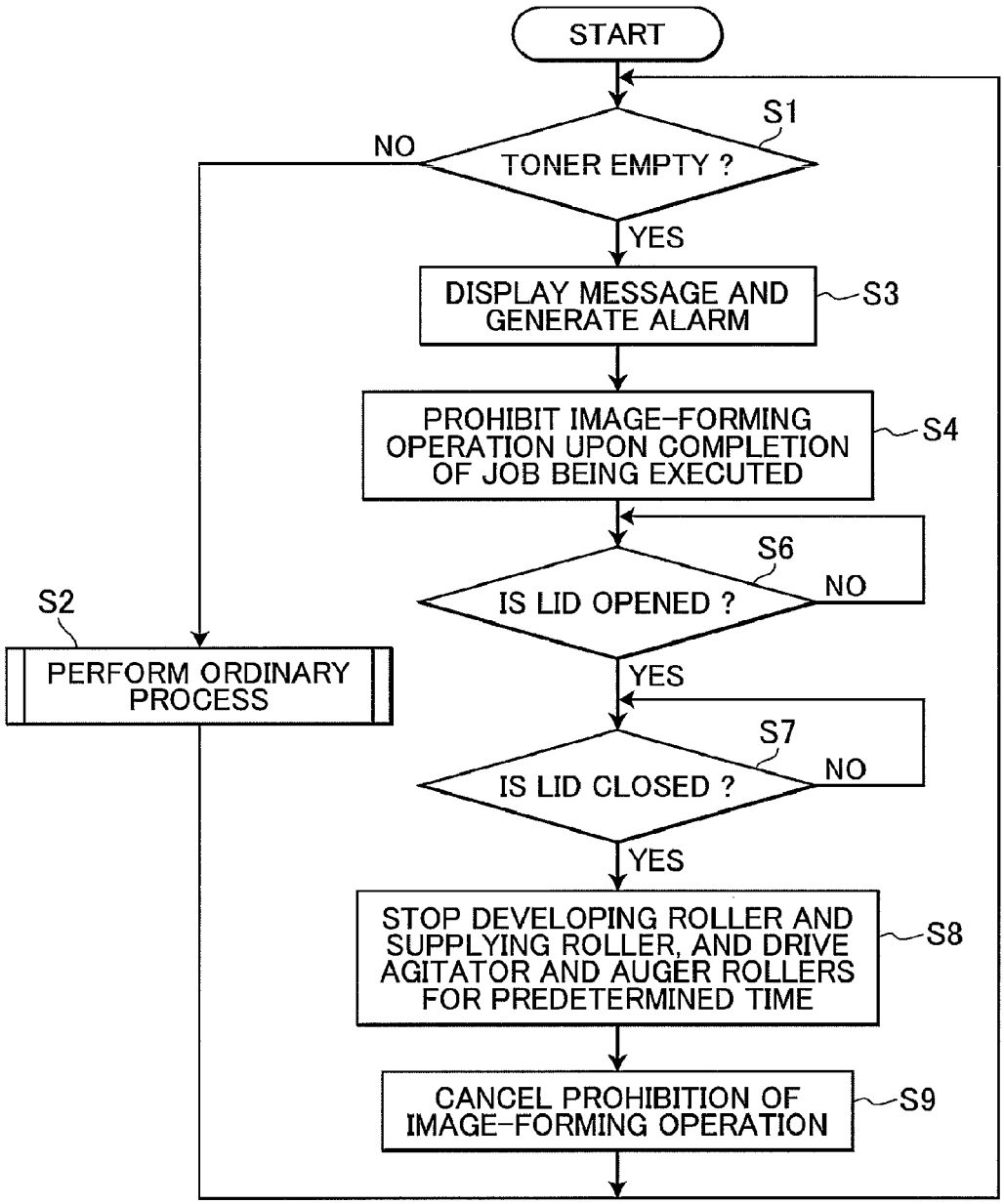
FIG. 17 is a flowchart explaining the process that the control system performs.

FIG. 17 is a flowchart explaining the process that the CPU 201 performs in accordance with the program stored in the ROM 202 according to the present embodiment. The process is repeatedly performed at predetermined timings, after the power switch of the laser printer 1 is turned on.

When the process starts, first, in S1, the CPU 201 determines whether the toner cartridge 60 is empty based on the detection signal outputted from the empty sensor 199. In other words, the CPU 201 determines whether or not the toner has been consumed so much that light keeps passing through the light-transmitting through-holes 42*d* for relatively long time. It is noted that light may pass through the light-transmitting through-holes 42*d* even when toner exists in a sufficient amount in the toner cartridge 60, because the agitator 61 agitates the toner in the inner cylinder 63. However, the length of time when light keeps passing through the through-holes 42*d* increases as the amount of toner in the cartridge 60 decreases. Thus, the CPU 201 determines whether the toner cartridge 60 is empty or not by detecting the length of time the light keeps passing through the through-holes 42*d*.

If the toner cartridge 60 is not empty in S1 (no in S1), the process goes to S2. In S2, an ordinary or normal process is carried out. For example, image forming operation is executed on the basis of data inputted to the laser printer 1. Then, the process returns from S2 to S1. Namely, the ordinary process is continued until in S1 that the toner cartridge 60 is determined to be empty.

It is noted that when the image-forming operation is executed in the normal process of S2, the electromagnetic clutch 275 is switched in the coupling state, and the development motor 170 is driven, thereby driving the developing roller 41, toner-supplying roller 45, upper auger roller 43, lower auger roller 44, and agitator 61. It is noted that the drum motor 122 is also driven to rotate the photosensitive drum 21.

On the other hand, when the toner cartridge 60 becomes empty (YES in S1), the process goes to S3. In S3, the display provided on the operation panel displays a message and a buzzer provided on the laser printer 1 generates an alarm, telling the user that the cartridge 60 has become empty. The toner empty is detected, often while the laser printer 1 is forming an image on a paper sheet. In view of this, an image-forming process is prohibited in S4 after an image-forming job that is presently being executed is completed.

In S6, the CPU 201 determines whether or not the lid 4 is opened. The process of S6 is repeated until the lid sensor 198 detects that the user opens the lid 4 in order to replace the toner cartridge 60 with a new one in response to the message or alarm generated in S3.

When the lid 4 is opened (YES in S6), the process goes to S7. In 7, the CPU 201 determines whether or not the user has closed the lid 4. The process of S7 is repeated until the lid 4 is closed by the user. While the lid 4 remains open, the user replaces the toner cartridge 60 with a new one in most cases. If the lid 4 is closed (YES in S7), the CPU 201 determines that the user has set a new toner cartridge 60 in the laser printer 1. Then, the process goes to S8.

In S8, the electromagnetic clutch 275 is switched to the disconnecting state, and then the development motor 170 is started to be driven. The upper auger roller 43, lower auger roller 44 and agitator 61 are driven for a predetermined period of time, while the developing roller 41 and toner-supplying roller 45 remain stopped. Hence, the old toner remaining in the development cartridge 40 and the new toner contained in the new toner cartridge 60 are circulated and are, thereby, mixed with each other. Upon lapse of the predetermined time, the laser printer 1 is released in S9 from the image-forming prohibiting mode set in S4. The process then returns to S1.

In the above-described sequence of steps, after the new toner cartridge 60 is coupled to the development cartridge 40, the upper auger roller 43, lower auger roller 44 and agitator 61 are driven for the predetermined period of time to mix the new toner and the old toner. Because the developing roller 41 and the toner-supplying roller 45 remain stopped for the predetermined time period, the toner is not electrically charged by friction. Undesirable print fogging can be prevented from occurring.

More specifically, the laser printer 1 uses non-magnetic single-component toner for frictional electrification. The non-magnetic single-component toner (particularly, styrene-acryl polymerized toner) becomes less chargeable as the toner is degraded. That is, old toner is less chargeable, and new toner is more chargeable. If the new toner and the old toner are mixed with each other and are electrically charged by friction; the toners will not be charged in the same polarity. The new toner will be positively charged, while the old toner will be negatively charged. If the new toner, which is positively charged, exists in a large amount near the developing roller 41, the new toner will dominantly stick to the developing roller 41 due to image force. Hence, no print fogging will take place even if the old toner, which is negatively charged, exists in the vicinity of the developing roller 41.

On the contrary, if the new toner is added to the old toner that is negatively charged and that is existing in a large amount near the developing roller 41, the old toner will dominantly stick to the developing roller 41 due to image force, thereby inevitably causing print fogging.

According to the present embodiment, the process of S8 is carried out after the toner cartridge 60 is replaced by a new one. The new toner and the old toner can mix with each other, without frictional electrification. After a large amount of new toner and a small amount of old toner have been mixed sufficiently uniformly, the developing roller 41 and the toner-supplying roller 45 will start being driven to charge toners by friction. In other words, frictional electrification, is prevented while a small amount of new toner and a large amount of old toner (i.e., degraded toner) are existing near the developing roller 41. Thus, print fogging can be prevented.

It is noted that the new toner and the old toner can be mixed faster if the development motor 170 is driven in S8 at a higher speed than in the ordinary image-forming operation (S2). In this case, the ordinary image-forming operation can be quickly started after the toner cartridge 60 is replaced by a new one.

Because the developing roller 41 and the toner-supplying roller 45 are provided in contact with each other, if the rollers 41 and 45 are driven to rotate, the particles of new toner and old toner move between these rollers 41 and in sliding contact and subject to frictional electrification. However, according to this embodiment, the developing roller 41 and the toner-supplying roller 45 are stopped for the predetermined time period during the process of S8. Accordingly, for the predetermined time period, the toner can be reliably prevented from frictional electrification.

Because all of the agitator 61 and the auger rollers 43 and 44 are driven in S8, toner can be circulated smoothly.

The higher the chargeability the toner has, the higher the possibility of print fogging. Because styrene-acryl polymerized toner has high chargeability, the above-described advantage of the present embodiment is prominent when the styrene-acryl polymerized toner is used. Because the polymerized toner has high fluidity, even when the developing, roller 41 is stopped in S8, this will influence little the circulation of toner. The influence of stopping the developing roller 41 in S8 on the circulation of toner can be minimized by using the polymerized toner.

The developing cartridge 40 can be replaced by a new one when the developing roller 41 is found degraded excessively. This improves maintenance efficiency. Similarly, the photosensitive-drum cartridge 20 can be replaced by a new one if the photosensitive drum 21 is found degraded. This also improves maintenance efficiency.

It is noted that no drive force is transmitted to the upper auger roller 43 or the lower auger roller 44 while the toner cartridge 60 remains disconnected from the development cartridge 40. If the upper auger roller 43 and lower auger roller 44 are driven with the toner cartridge 60 disconnected, the toner will possibly overflow the development cartridge 40. Since neither the upper auger roller 43 nor the lower auger roller 44 is driven unless or until the toner cartridge 60 is coupled to the development cartridge 40, the toner is reliably prevented from overflowing the development cartridge 40 as described above.

More specifically, when the toner cartridge 60 is coupled to the developing cartridge 40, a drive force is inputted from the drive shaft 161 on the main body of the laser printer 1 to the left-side axial end of the rotational shaft 61 of the agitator 61 through the drive coupling. The drive force is then outputted from the rotational shaft 61 of the agitator 61 to the auger rollers 43 and 44 through the gear 61*b* that is located on the right-side axial end of the rotational shaft 61*a*. The auger rollers 43 and 44 are thereby driven. When the toner cartridge 60 is disconnected from the developing cartridge 40, the rotational shaft 61*a* having the drive-force input portion (left-side axial end) and the drive-force output portion (gear 61*b*) are also removed. The drive force can no longer be transmitted to the auger roller 43 or 44. The auger rollers 43 and 44 are prevented from operating while the toner cartridge 60 remains disconnected from the developing cartridge 40. This prevents the toner from overflowing the developing cartridge 40.

As long as the toner cartridge 60 is coupled to the developing cartridge 40, the auger rollers 43 and 44 and the agitator 60 operate in conjunction with each other. Thus, the laser printer 1 can be controlled easily.

The left-side axial end of the rotational shaft 61*a* couples with the drive shaft 161 to receive the drive force, while the gear 61*b* is provided on the right-side axial end of the rotational shaft 61*a* to output the drive force to the auger rollers 43 and 44. Thus, the portion receiving the drive force and the portion outputting the drive force are provided on the opposite sides of the toner cartridge 60. It is possible to easily design the driving system, such as the gear arrangement, that is located near to the driving-force inputting portion and the driving-force outputting portion. It is possible to easily make compact the toner cartridge 60, the development cartridge 40, and the laser printer 1.

More specifically, in the developing cartridge, 40, the developing roller 41 and the auger rollers 43 and 44 have to be arranged close to each other. The toner-supplying roller 45 has to be further arranged in the developing cartridge 40. According to the present embodiment, therefore, one drive mechanism is provided on one side (left side) of the developing cartridge 40 to drive the developing roller 41 and the toner-supplying roller 45 and another drive mechanism is provided on the other side (right side) of the developing cartridge 40 to drive the auger rollers 43 and 44. Then, a drive force is transmitted via the toner cartridge 60 (rotational shaft 61*a*) from one side (left side) of the toner cartridge 60 to the other side (right side) thereof. Thus, all of the developing roller 41, the toner-supplying roller 45, and the auger rollers 43 and 44 can be driven by the single development motor 170. It is unnecessary to mount two motors each on one side of the developing cartridge 40. It is possible to make compact the laser printer 1.

The pair of auger rollers 43 and 44 having simple configuration are used to circulate toner. This helps to reduce the manufacturing cost of the laser printer 1.

Modification of the First Embodiment

In the first embodiment described above, when the new toner cartridge 60 is coupled to the development cartridge 40, new toner is mixed with old toner in S8, while stopping the developing roller 41 and toner-supplying roller 45. Instead, according to the modification of the first embodiment, new toner can be mixed with old toner while stopping the developing roller 41 only as will be described below.

Figure 18A:
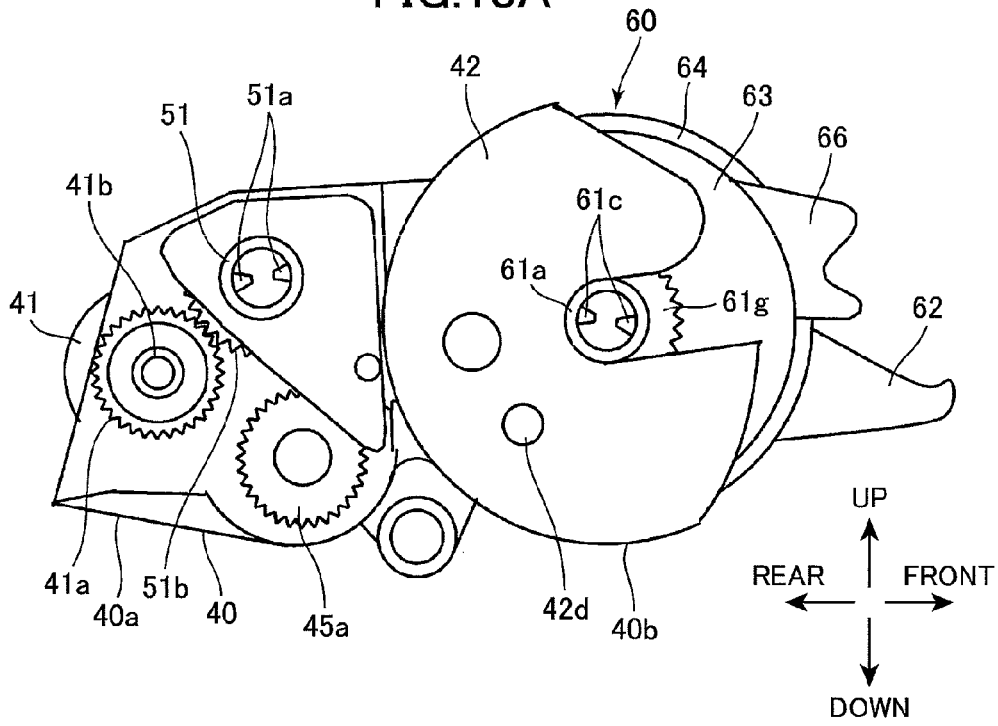
FIG. 18A is a left-side view showing the toner cartridge and the development cartridge when they are coupled with each other according to a modification of the first embodiment.
Figure 18B:
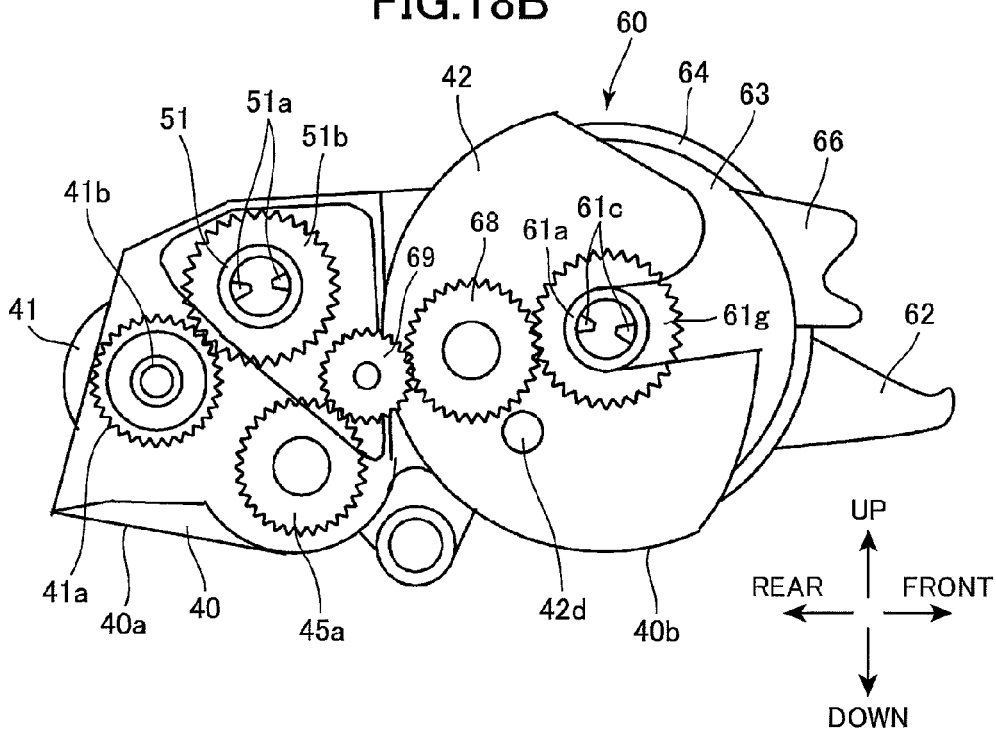
FIG. 18B is a left-side view showing the toner cartridge and the development cartridge when they are coupled with each other according to the modification of the first embodiment, showing some gears that are hidden, not indicated in FIG. 18A.

As shown in FIGS. 18A and 18B, the gear 51*b*, which rotates integrally with the drive shaft 51, is in engagement with the gear 41*a* that rotates integrally with the developing roller 41, but is not in engagement with the gear 45*a* that rotates integrally with the toner-supplying roller 45. A gear 61*g* is secured to the left-side end of the rotational shaft 61*a* of the agitator 61 and rotates integrally with the rotational shaft 61*a*. The gear 61*g* is located on the outer side of the left-side end wall of the inner cylinder 63. Gears 68 and 69 are provided on the inner surface of the left-side wall of the development cartridge 40, and are in engagement with each other. The gear 69 is in engagement with the gear 45*a*. The gear 68 is brought into engagement with the gear 61*g* when the toner cartridge 60 is mounted in the development cartridge 40. Hence, the developing roller 41 can be rotated when a drive force is transmitted from the drive shaft 151 to the drive shaft 51. The toner-supplying roller 45, agitator 61, upper auger roller 43 and lower auger roller 44 can be rotated when a drive force is transmitted from the drive shaft 161 to the rotational shaft 61*a*.

Figure 19:
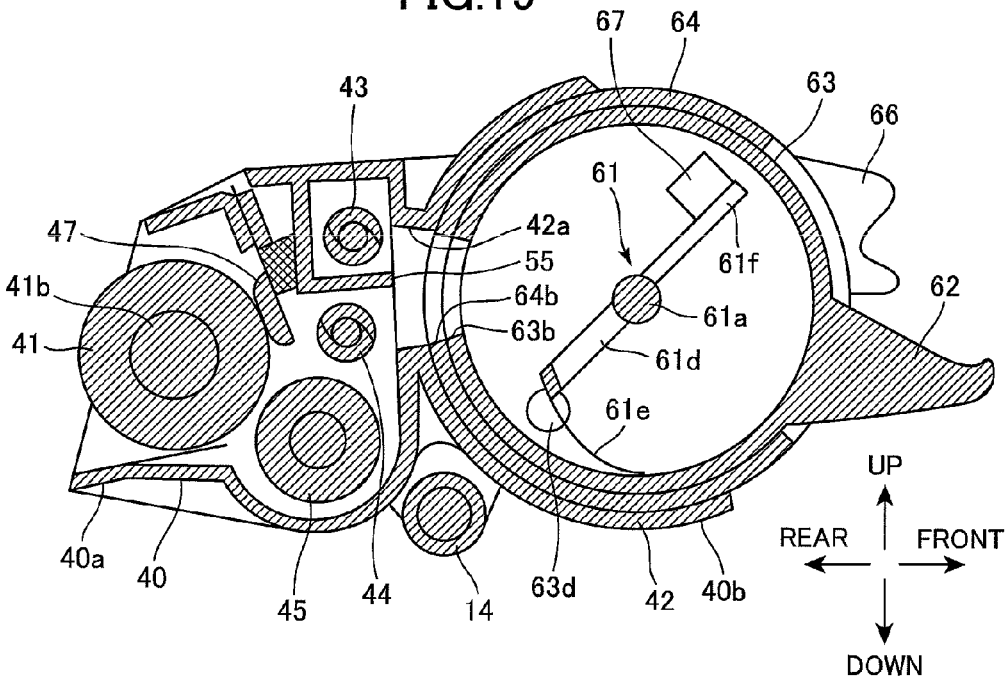
FIG. 19 is a sectional view illustrating the inner structures of the toner cartridge and development cartridge when they are coupled with each other.

As shown in FIG. 19, the toner-supplying roller 45 is spaced apart from and located out of contact from the developing roller 41. Therefore, even when the toner-supplying roller 45, agitator 61, upper auger roller 43 and lower auger roller 44 are rotated and only the developing roller 41 remains stopped, toner will not be subjected to friction while moving between the developing roller 41 and the toner-supplying roller 45. Thus, toner will not be electrically charged by friction. Thus, this variation can attain the same advantage as the first embodiment when the laser printer 1 performs the process the same as that described above with reference to FIG. 17. That is, when the electromagnetic clutch 275 is switched to the disconnecting mode and the development motor 170 is driven in S8, the toner-supplying roller 45, upper auger 43, lower auger 44 and agitator 61 are driven for the predetermined time, while the developing roller 41 remains stopped. For the predetermined time, the new toner and the old toner can be mixed uniformly, without being electrically charged by friction.

Since the developing roller 41 and the toner-supplying roller 45 are arranged, not contacting each other, the toner particles never move between these rollers 41 and 45 in sliding contact for frictional electrification. Even though the toner-supplying roller 45 rotates while the upper auger roller 43, lower auger roller 44 and agitator 61 are driven for the predetermined time, because the developing roller 41 is stopped rotating, the toner can be prevented from frictional electrification for the predetermined time.

Second Embodiment

Next will be described a second embodiment with reference to FIGS. 20-27.

The second embodiment is different from the first embodiment in the manner how the components in the development cartridge 40 and toner cartridge 60 are driven.

Figure 20:
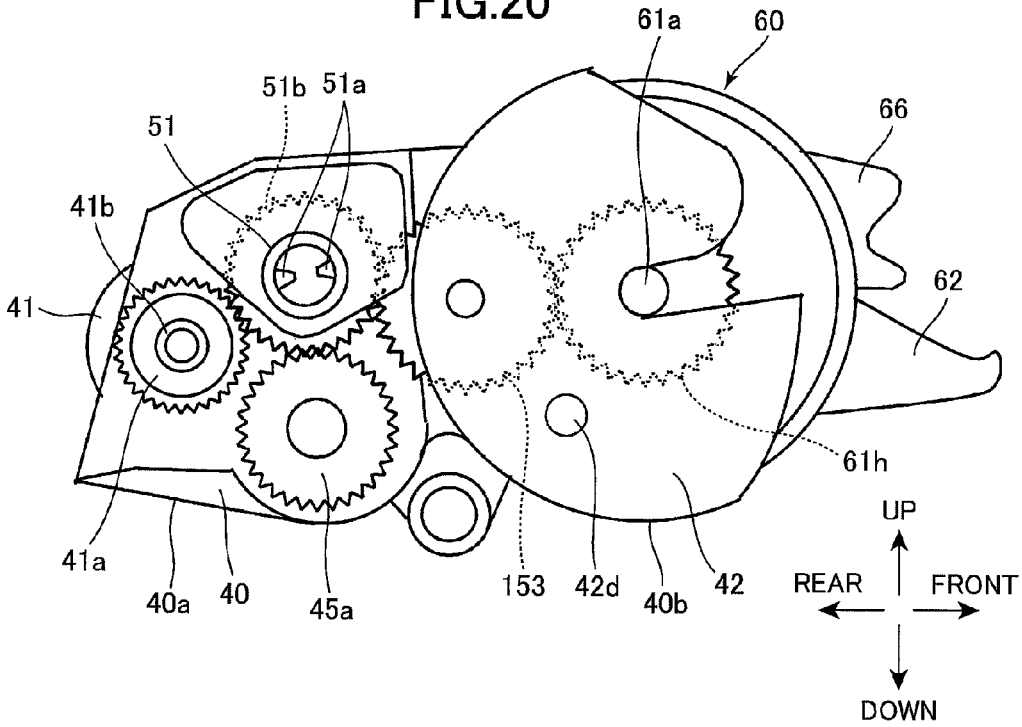
FIG. 20 is a left-side view showing the toner cartridge and the development cartridge when they are coupled with each other according to a second embodiment.

The configurations of the development cartridge 40 and toner cartridge 60 are the same as those of the first embodiment except for the following points:

The left-side axial end of the rotational shaft 61*a* has no configuration that constitutes the above-described drive coupling. The gear 61*b* is not provided on the right-side axial end of the rotational shaft 61*a*. Instead, as shown in FIG. 20, a gear 61*h* is integrally formed with the rotational shaft 61*a* at the left-side axial end thereof. The gear 61*h* is located on the outer side of the left-side end wall of the inner cylinder 63.

A gear 153 is provided on the inner surface of the left-side end wall of the toner-cartridge holder 42. The gear 153 is in engagement with the gear 51*b*. The gear 153 is located as being opposed to the gear 61*h* when the toner cartridge 60 is mounted in the development cartridge 40. Accordingly, the gear 153 comes into engagement with the gear 61*h* when the toner cartridge 60 is coupled to the development cartridge 40. Thus, the drive force is transmitted from the drive shaft 51 via the gears 51*b*, 153 and 61*h* to the rotational shaft 61*a* of the agitator 61.

Figure 21:
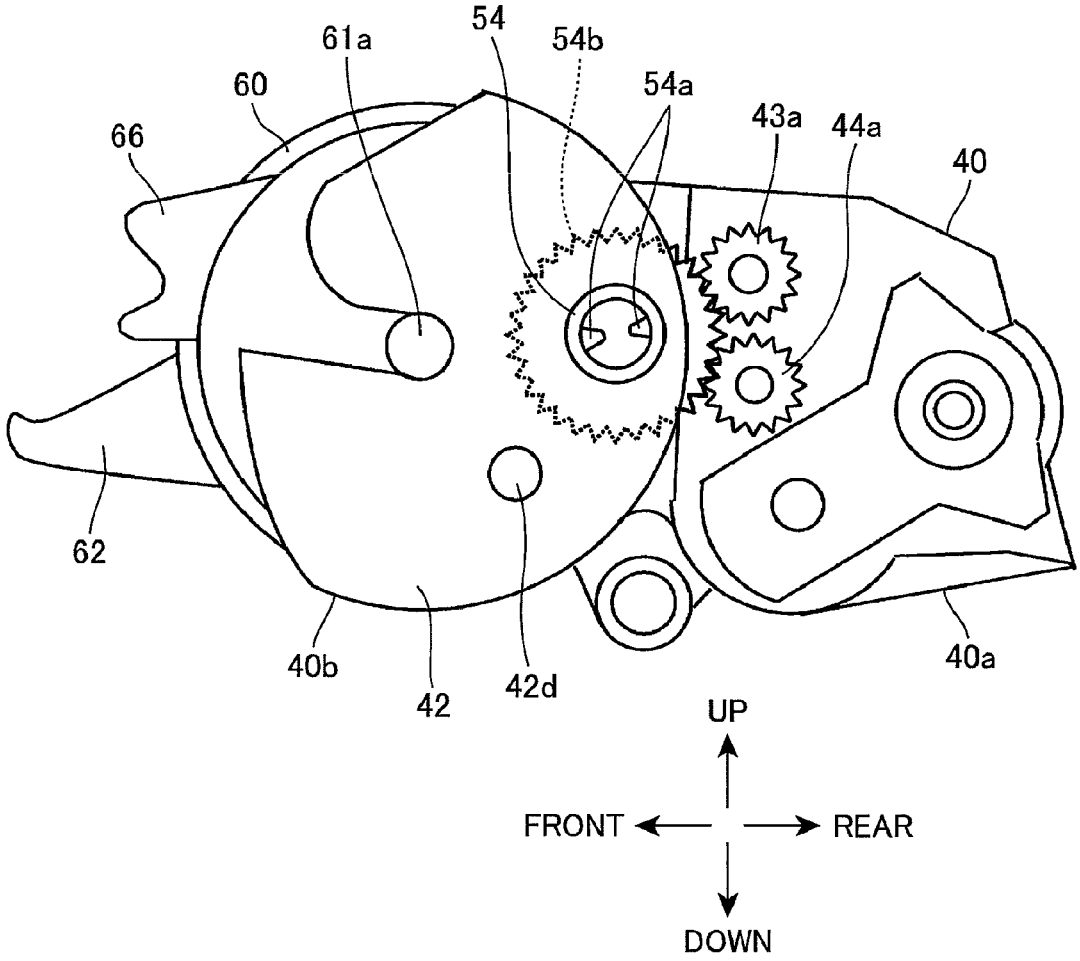
FIG. 21 is a right-side view showing the toner cartridge and the development cartridge when they are coupled with each other according to the second embodiment.
Figure 25:
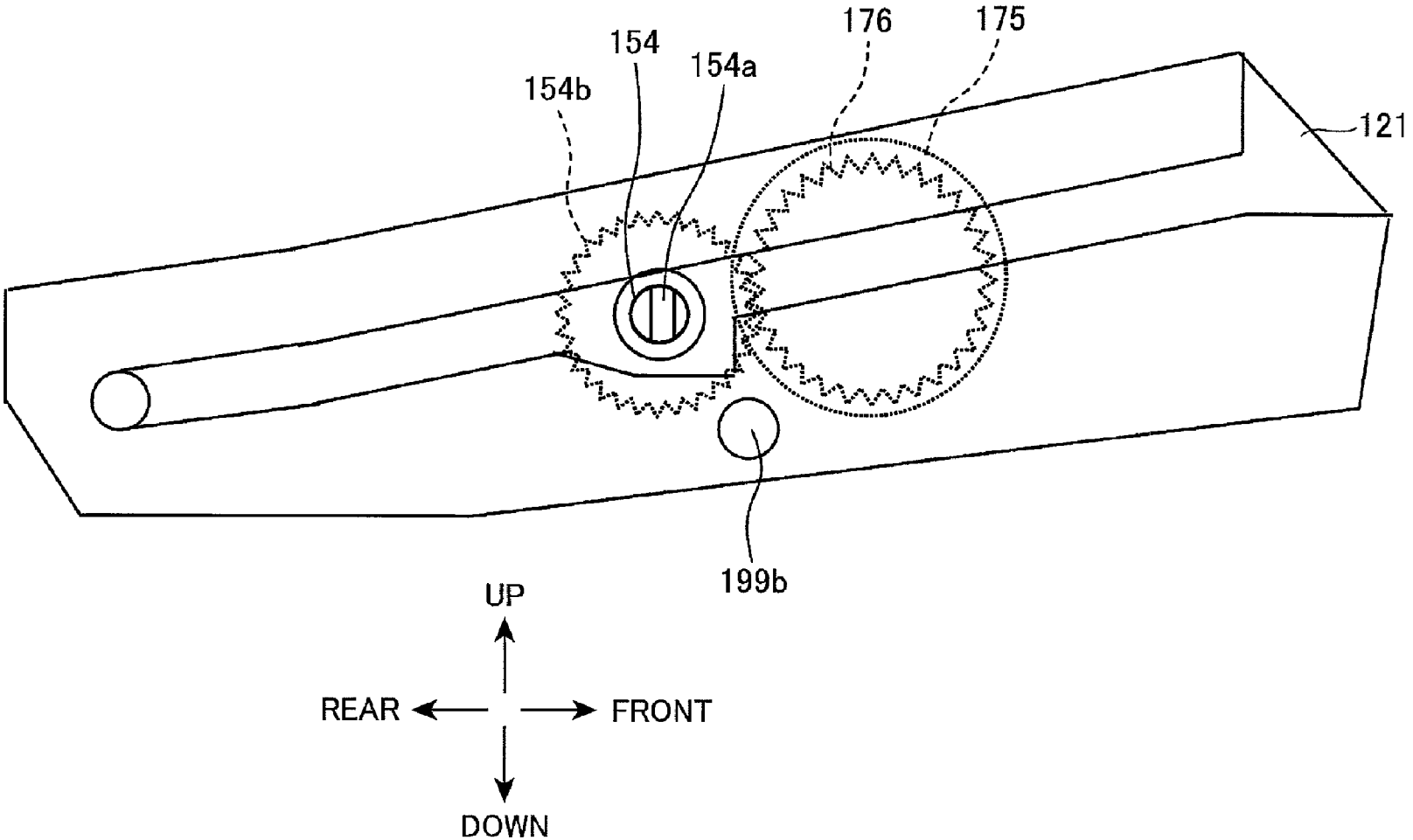
FIG. 25 is an enlarged view showing the configuration on a part of the inner surface of the right-side wall in the main body of the laser printer according to the second embodiment.

As shown in FIG. 21, a drive shaft 54 is provided on the right side of the toner-cartridge holder 42. As shown in FIG. 25, a drive shaft 154 is provided on the inner surface of the right-side wall in the main body of the laser printer 1. The drive shafts 54 and 154 constitute a so-called drive coupling. The drive shaft 154 has on its axial tip end a projection 154*a* that is shaped like a flat plate. The drive shaft 54 has a hollow cylindrical portion at its axial tip end. The drive shaft 54 has two projections 54*a* that can engage with the plate-shaped projection 154*a*. The drive shaft 154 can therefore be fitted in the drive shaft 54.

A gear 54*b* is mounted on and secured to the drive shaft 54 and is located on the inner surface of the right-side end wall of the toner-cartridge holder 42. The gear 54*b* is in engagement with the gears 43*a* and 44*a* that are secured to the upper and lower auger rollers 43 and 44, respectively.

Hence, the upper and lower auger rollers 43 and 44 can be rotated when the drive shaft 154 transmits a drive force to the drive shaft 54.

Figure 22A:
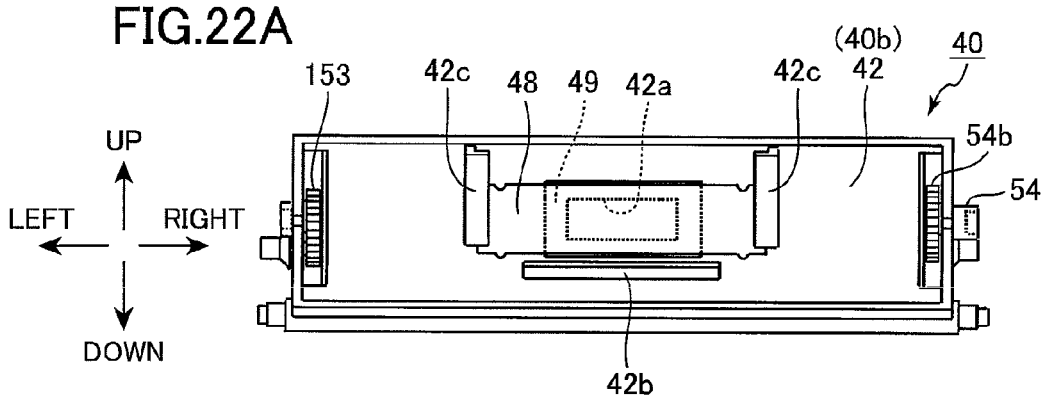
FIG. 22A is a front view of the toner-cartridge holder in the development cartridge as viewed from the toner cartridge side when the toner cartridge is disconnected from the development cartridge according to the second embodiment.
Figure 22B:
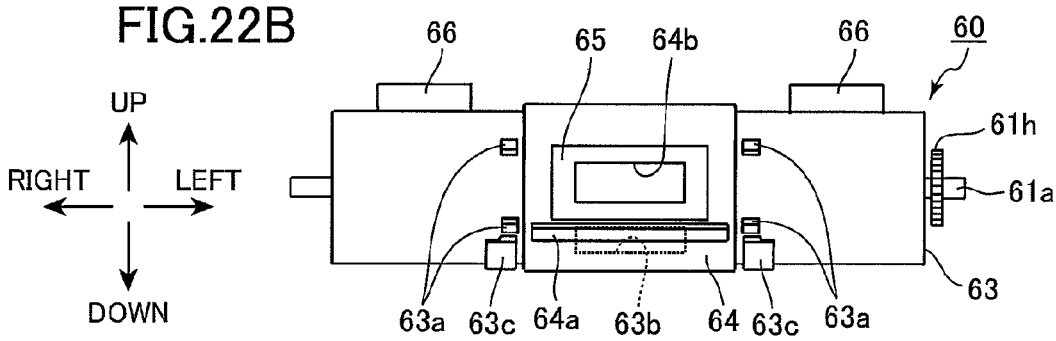
FIG. 22B is a rear view of the toner cartridge as viewed from the toner-cartridge holder side when the toner cartridge is disconnected from the development cartridge according to the second embodiment.
Figure 22C:
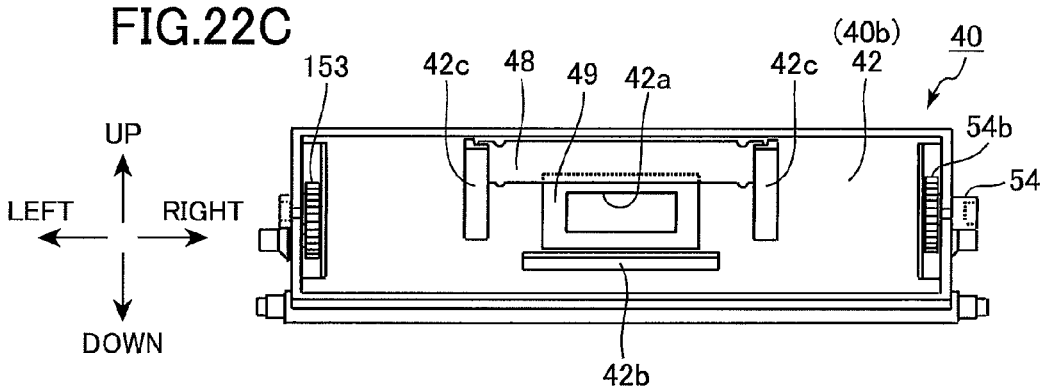
FIG. 22C is a front view of the toner-cartridge holder in the development cartridge as viewed from the toner cartridge side when the toner cartridge is coupled to the development cartridge according to the second embodiment.
Figure 22D:
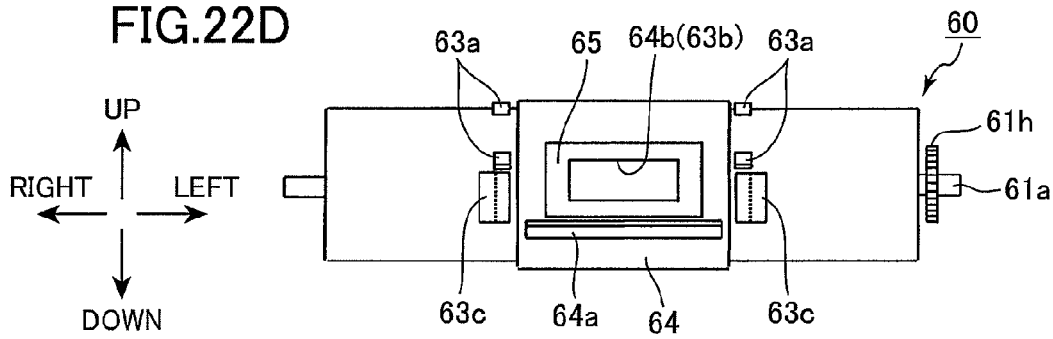
FIG. 22D is a rear view of the toner cartridge as viewed from the toner-cartridge holder side when the toner cartridge is coupled to the development cartridge according to the second embodiment.

It is noted that the toner cartridge 60 is coupled to and disconnected from the development cartridge 40 in the same manner as in the first embodiment. That is, FIGS. 22A and 22B show the state where the toner cartridge 60 is disconnected from the development cartridge 40 according to the second embodiment, that is, the handle 62 of the cartridge 60 has been rotated upwards to the disconnecting position as of FIG. 6. FIGS. 22C and 22D show the state where the toner cartridge 60 is coupled to the development cartridge 40 according to the second embodiment, that is, the handle 62 of the cartridge 60 has been rotated downwards to the coupling position as of FIG. 4. FIGS. 22A-22D correspond to FIGS. 12A-12D of the first embodiment, respectively.

Figure 23:
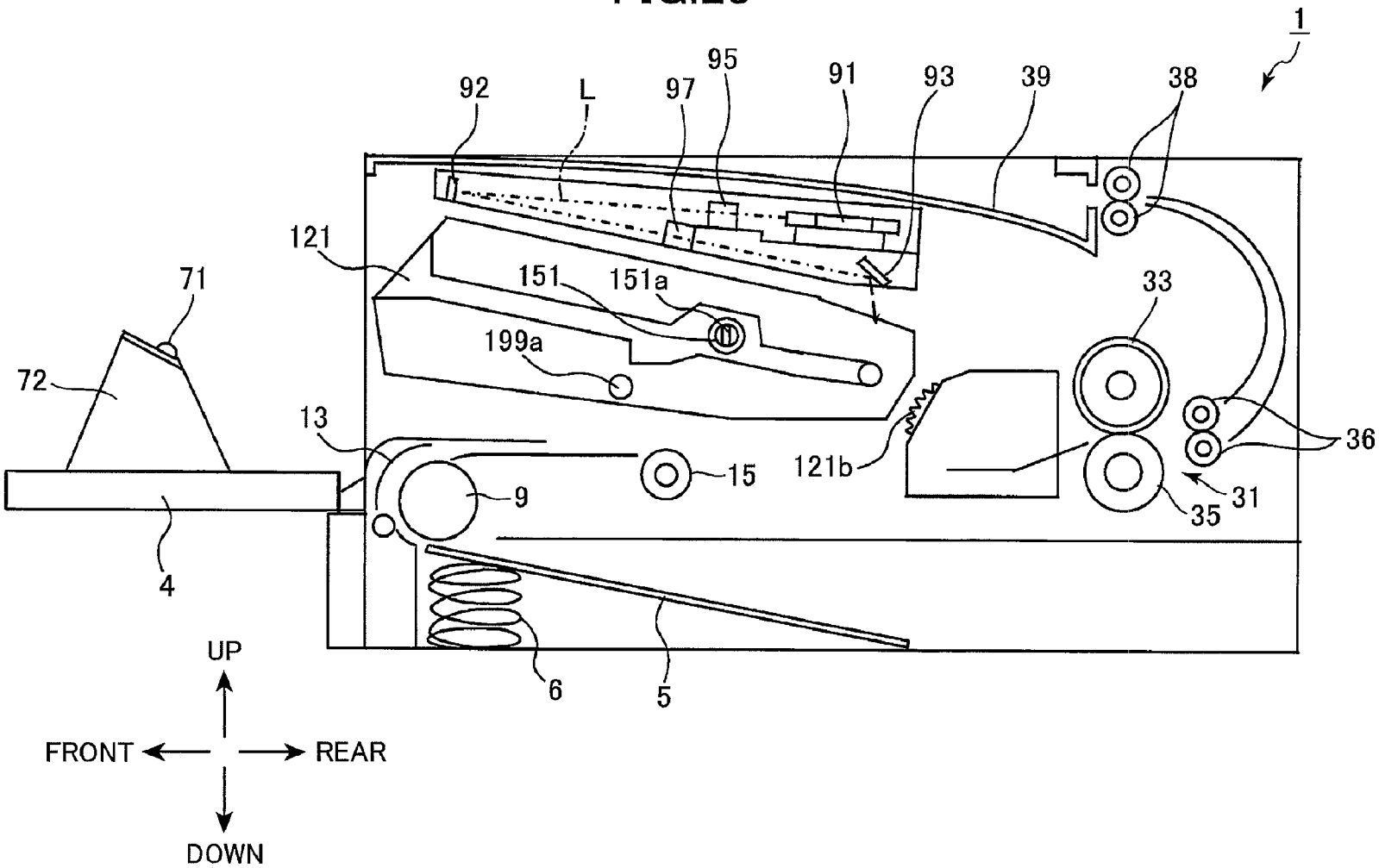
FIG. 23 shows the configuration on the inner surface of the left-side wall in the main body of the laser printer according to the second embodiment.

The configuration of the laser printer 1 according to the second embodiment is the same as that of the first embodiment except for the following points:

As shown in FIG. 23, according to the second embodiment, no drive shaft 161 is provided on the left-side wall in the main body of the laser printer 1.

Figure 24:
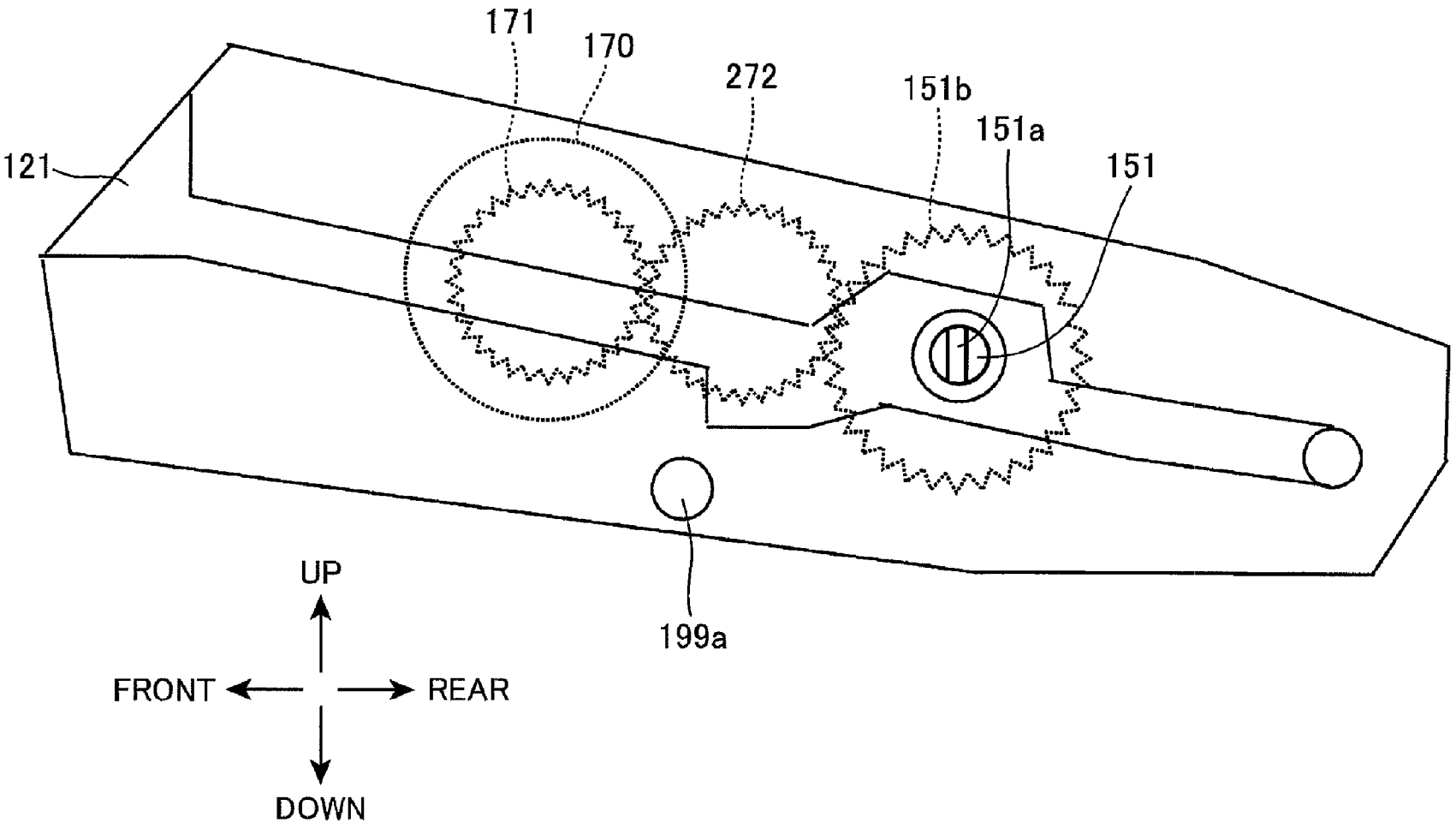
FIG. 24 is an enlarged view showing the configuration on a part of the inner surface of the left-side wall in the main body of the laser printer shown in FIG. 23.

As shown in FIG. 24, according to the present embodiment, a gear 151*b* is provided to rotate integrally with the drive shaft 151. The gear 151*b* is in engagement with the gear 171 through a gear 272. Similarly to the first embodiment, the gear 171 rotates integrally with the development motor 170. Accordingly, when the development motor 170 is driven, the drive shaft 51 drives the developing roller 41, toner-supplying roller 45, and agitator 61.

A drive system shown in FIG. 25 is provided on the inner surface of the right-side wall in the main body of the laser printer 1. This drive system is located as being opposed to the drive system shown in FIG. 24. As shown in FIG. 25, the right-side wall in the main body of the laser printer 1 also has the guide groove 121 formed on the inner surface thereof. The guide groove 121 guides the rotational shaft 21*a* of the photosensitive drum 21. The drive shaft 154 is provided at the middle part of the guide groove 121. A gear 154*b* is provided to rotate integrally with the drive shaft 154. A returning motor 175 is provided on the right-side wall in the main body of the laser printer 1. A gear 176 is provided to rotate integrally with a rotational shaft of the returning motor 175. The gear 154*b* is in engagement with the gear 176. Accordingly, when the returning motor 175 is driven, the drive shaft 54 can drive the upper and lower auger rollers 43 and 44 at the same time.

Note that the drive shafts 151 and 154 can protrude and retreat similarly to the drive shafts 151 and 161 in the first embodiment. The shafts 151 and 154 are connected to a link mechanism (not shown), so that the shafts may protrude when the lid 4 is closed, and may retreat when the lid 4 is opened. When the lid 4 is opened, the shafts 151 and 154 retreat, coming out of the engagement with the drive shafts 51 and 54, respectively. Thus, the photosensitive cartridge 20, development cartridge 40 and toner cartridge 60 can be removed from the main body of the laser printer 1. When the lid 4 is closed, the drive shafts 151 and 154 protrude, coming into engagement with the drive shafts 51 and 54. In this case, the above-mentioned components can be driven.

As shown in FIG. 25, a light-receiving element 199*b* is provided on the inner surface of the right-side wall in the main body of the laser printer 1. The empty sensor 199 is constituted from the light-emitting element 199*a* shown in FIGS. 23 and 24 and the light-receiving element 199*b*.

Figure 26:
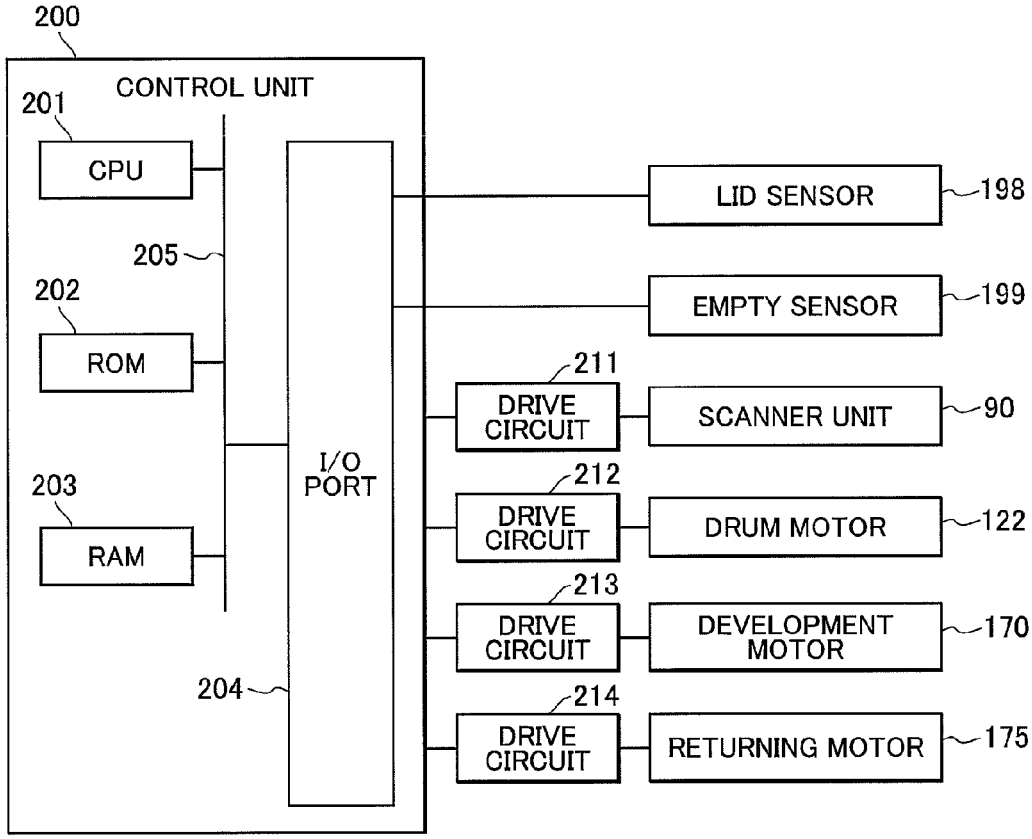
FIG. 26 is a block diagram illustrating the configuration of the control system incorporated in the laser printer according to the second embodiment.
Figure 27:
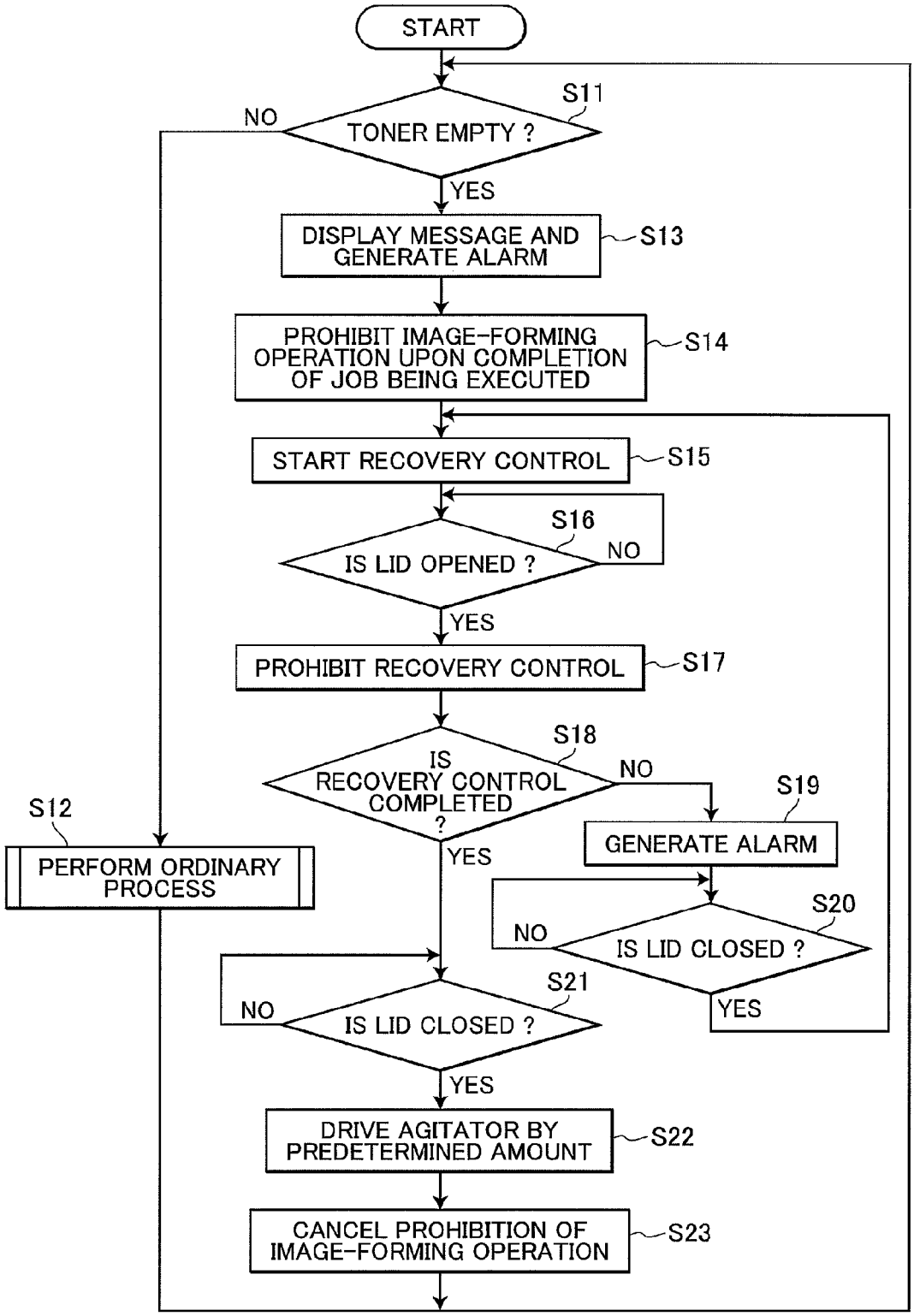
FIG. 27 is a flowchart explaining the process that the control system performs according to the second embodiment.

As shown in FIG. 26, the control system of the laser printer 1 according to the present embodiment is the same as that according to the first embodiment (FIG. 16) except that the returning motor 175 is provided in place of the electromagnetic clutch 275 and that a program, whose flowchart is shown in FIG. 27, is stored in the ROM 202 in place of the program of FIG. 17.

Next will be described, with reference to FIG. 26, the process that the CPU 201 of the control unit 200 performs in accordance with the program stored in the ROM 202 according to the present embodiment.

Similarly to the first embodiment, this process is repeatedly performed at predetermined timings, after the power switch of the laser printer 1 is turned on. When the process starts, first, the process of S11 is executed. It is noted that processes of S11-S14 are the same as the processes of S1-S4 of the first embodiment.

After prohibiting image formation in S14, the program proceeds to S15.

In S15, the recovery control is started. That is, the returning motor 175 is driven, whereas the development motor 170 remains stopped. As a result, the agitator 61 stops supplying toner from the toner cartridge 60, and the developing roller 41 and toner-supplying roller 45 stop rotating. On the other hand, the upper and lower auger rollers 43 and 44 are driven. The lower auger roller 44 transports the toner in the development cartridge 40 to the left and right sides, and then the upper auger roller 43 transports the toner to the middle part. The toner is returned into the toner cartridge 60 through the opening 42*a*. This recovery control is continued, as an independent routine, for a period of time that is long enough to completely recover toner in the development cartridge 40 to the toner cartridge 60. When the toner is completely recovered, the recovery control is automatically stopped. That is, the returning motor 175 is stopped, while the development motor 170 remains stopped.

In S16, the CPU 201 judges whether or not the lid 4 is opened after the recovery control is started. If the user has not opened the lid 4 in spite of the message or alarm generated in S13 (NO in S16), the process of S16 is repeated until the lid sensor 198 detects that the user opens the lid 4 to replace the toner cartridge 60 with a new one.

When the lid 4 is opened (YES in S16), the recovery control is prohibited in S17. Then, in S18, the CPU 201 judges whether or not the recovery control has been completed. If the recovery control has not yet been completed (NO in S18), the process goes to S19. In S19, an alarm is generated, informing the user that the toner cartridge 60 cannot be replaced by a new one. Then, in S20, the CPU 201 judges whether or not the user has closed the lid 4 upon hearing the alarm. If the user has not yet closed the lid 4 (NO in S20), the process of S20 is repeatedly performed until the user closes the lid 4. If the user closes the lid 4 (YES in S20), the process goes back to S15, in which the recovery control is carried out.

If the lid 4 is opened after the recovery control has been completed (YES in S18), the process goes to S21. In S21, the CPU 201 judges whether or not the lid 4 has been closed. The process of S21 is repeated until the lid 4 is closed. Normally, the user replaces the toner cartridge 60 with a new one during the repetition of the process of S21. If the user closes the lid 4 (YES in S21), the process goes to S22. In S22, the agitator 61 is driven by a predetermined amount, filling toner in the development cartridge 40. For example, the agitator 61 is driven for a predetermined period of time. The process then goes to S23, in which the laser printer 1 is released from the image-forming prohibiting mode set in S14. The process then returns to S11.

Thus, in this embodiment, toner in the development cartridge 40 is automatically recovered into the toner cartridge 60 (in S15) if the toner cartridge 60 becomes empty (YES in S11). The toner cartridge 60 is replaced with a new one after the toner has been recovered into the toner cartridge 60.

That is, when the recovery control has been completed (YES in S18), the toner (i.e., old toner degraded) remains only in a small amount in the development cartridge 40. In this state, the toner cartridge 60 can be replaced by a new one. It is therefore possible to prevent a large amount of old toner from being mixed with new toner when the new toner is supplied from the new toner cartridge 60. Accordingly, print fogging can be avoided also in the present embodiment.

As the toner is circulated in the development cartridge 40 by the auger rollers 43 and 44 in S15, the toner can be homogenized and can be sufficiently returned to the toner cartridge 60.

The developing roller 41 transports the toner toward the photosensitive drum 21. Therefore, by stopping the developing roller 41 in S15, the toner can be more efficiently returned into the toner cartridge 60.

In the above description, the agitator 61 is driven by the predetermined amount (that is, for the predetermined time period, for example) in S22 after the toner cartridge 60 is replaced by a new none (YES in S21). Then, the image-forming prohibiting mode is canceled in S23. This brings forth the following advantages.

The user will possibly mount the old toner cartridge again to the development cartridge 40 in error, not replacing the toner cartridge 60 with a new one, even when the toner empty is detected. In this case, toner has been recovered into the toner cartridge 60 in a large amount in S15, and a false detection will possibly occur in S11. However, according to the present embodiment, the process returns to S11 after the agitator 61 is driven by the predetermined amount (for the predetermined time, for example) in S22 after the toner cartridge 60 is replaced with some toner cartridge (yes in S21). Accordingly, it is possible to prevent such a detection error from occurring.

In addition, because the process returns to S11 after the agitator 61 is driven by the predetermined amount (for the predetermined time, for example) in S22 after the toner cartridge 60 is replaced by some one (yes in S21), it is ensured that image-forming operation will be carried out, always with the development cartridge 40 filled with a sufficiently large amount of toner. It is possible to prevent images from suffering from being too thinned.

It is noted that the size of the predetermined amount (the length of the predetermined period of time, for example) for agitation in S22 can be set in advance to an appropriate value in accordance with the configurations of the toner cartridge 60 and the agitator 61 in order to prevent false detection.

While the invention has been described in detail with reference to the above-described embodiments, it would be apparent to those skilled in the art that various changes and modifications may be made therein without departing from the spirit of the invention.

For example, in the above description, whether the toner cartridge 60 should be replaced with a new one is determined by detecting the amount of toner that remains in the toner cartridge 60. Instead, whether the toner cartridge 60 should be replaced may be determined by detecting how many paper sheets have been printed.

In the above description, whether the toner cartridge 60 has been replaced is determined by the lid sensor 198. However, whether the toner cartridge 60 has been replaced may be determined by the empty sensor 199. Alternatively, the replacement of the toner cartridge 60 may be detected by using an IC tag attached to the toner cartridge 60 and an IC-tag reader provided on the laser printer 1.

The laser printer 1 can be modified to various image forming apparatuses of electronic photographic type, such as copying apparatuses, facsimile apparatuses and color laser printers. The photosensitive drum 21 may be modified into a photoelectric belt. A non-photosensitive electrostatic latent image bearing body may be provided instead of the photosensitive drum 21. An intermediate transfer belt may be used to transfer toner images onto a recording medium.

In the above description, since the photosensitive-drum cartridge 20 and the development cartridge 40 are detachably mounted in the main body of the laser printer 1, they can be replaced by new ones when necessary. This facilitates easy maintenance of the laser printer 1. However, the photosensitive-drum cartridge 20 and the development cartridge 40 may be fixedly secured in the main body of the laser printer 1.

In the above description, the photosensitive-drum cartridge 20 and the development cartridge 40 can be disconnected from each other. This facilitates easy maintenance of the photosensitive-drum cartridge 20 and the development cartridge 40. However, the photosensitive-drum cartridge 20 and the development cartridge 40 may be formed integrally with each other into a process cartridge. The photosensitive-drum cartridge 20 and the development cartridge 40 may not be disconnected from each other.

In the above-described first and second embodiments, styrene-acryl polymerized toner is used. However, any polymerized toner can be used in place of the styrene-acryl polymerized toner. Toner other than polymerized toner can also be used.

What is claimed is:

1. An image forming apparatus, comprising:

a casing formed with an opening;

an electrostatic latent image bearing member having a surface on which an electrostatic latent image is formed;

a toner cartridge that contains toner;

a developing member that supplies the toner from the toner cartridge onto the surface of the electrostatic latent image bearing member, thereby developing the electrostatic latent image into a toner image;

a transfer member that transfers the toner image from the surface of the electrostatic latent image bearing member to a recording medium;

a developing device, to which the toner cartridge is removably coupled and which incorporates the developing member;

a supplying member that supplies the toner from the toner cartridge to the developing device;

a returning member that recovers the toner from the developing device into the toner cartridge, the returning member being able to operate independently from the supplying member;

a mounting/detaching detecting unit that detects whether the toner cartridge is mounted to or detached from the casing, or whether the opening is opened or closed;

a replacement-timing detecting unit that detects whether the toner cartridge should be replaced with a new one based on an amount of toner contained in the toner cartridge; and a control unit that, when the replacement-timing detecting unit determines that the toner cartridge should be replaced with a new one, performs a recovery control causing the returning member to be operated while supplying member is stopped, wherein after executing the recovery control, if the mounting/detaching detecting unit detects that the toner cartridge is mounted to the developing device or that the opening is closed, the control unit controls the supplying member to be operated by a predetermined amount while the returning member is stopped, wherein after operating the supplying member by the predetermined amount, the replacement-timing detecting unit determines whether the toner cartridge should be replaced with a new one.

2. The image forming apparatus according to claim 1, wherein the returning member circulates the toner in the developing device, thereby returning the toner into the toner cartridge.

3. The image forming apparatus according to claim 1, wherein the developing device is removably provided.

4. The image forming apparatus according to claim 1, wherein the electrostatic latent image bearing body is removably provided.

5. The image forming apparatus according to claim 1, wherein the developing member is stopped when the returning member operates while the supplying member is being stopped.

6. The image forming apparatus according to claim 1, wherein the toner is a non-magnetic single-component toner.

* * * * *